US010899501B2

(12) United States Patent
Key

(10) Patent No.: US 10,899,501 B2
(45) Date of Patent: Jan. 26, 2021

(54) CONTAINER WITH ROTATING SHRINK LABEL LOCKING FEATURES AND PROMOTIONAL LABEL SYSTEM

(71) Applicant: SpinLabel Technologies, Inc., Boca Raton, FL (US)

(72) Inventor: Stephen Marcus Key, Glenbrook, NV (US)

( * ) Notice: Subject to any disclaimer, the term of this patent is extended or adjusted under 35 U.S.C. 154(b) by 450 days.

(21) Appl. No.: 14/279,289

(22) Filed: May 15, 2014

(65) Prior Publication Data

US 2014/0339120 A1 Nov. 20, 2014

Related U.S. Application Data

(60) Provisional application No. 61/832,455, filed on Jun. 7, 2013, provisional application No. 61/828,845, filed on May 17, 2013.

(51) Int. Cl.
*G09F 3/02* (2006.01)
*B65D 25/36* (2006.01)
(Continued)

(52) U.S. Cl.
CPC ..... *B65D 25/36* (2013.01); *B65D 23/0878* (2013.01); *B65D 23/14* (2013.01); *G09F 3/02* (2013.01); *G09F 3/0288* (2013.01); *G09F 3/04* (2013.01); *B65D 2203/00* (2013.01); *B65D 2203/02* (2013.01); *B65D 2203/12* (2013.01);
(Continued)

(58) Field of Classification Search
CPC .... B65D 23/00; B65D 23/0878; B65D 23/14; B65D 23/12; B65D 25/36; B65D 2203/02; B65D 2203/12; B65D 2203/00; B65C 3/065; B65C 9/20; G09F 3/04; G09F 3/02; G09F 3/0288; G09F 2003/0213; G09F 2003/021; G09F 2003/0251; G09F 2003/0272; G09F 2003/0205; G09F 2003/0273
See application file for complete search history.

(56) References Cited

U.S. PATENT DOCUMENTS 332,208 A 12/1885 Noel
736,035 A 8/1903 Stevenson
(Continued)

FOREIGN PATENT DOCUMENTS

AT 932891 4/2002
AT 1165378 9/2004
(Continued)

OTHER PUBLICATIONS

International Search Report and Written Opinion dated May 25, 2012 in Patent Cooperation Treaty Application No. PCT/US12/22609, filed Jan. 25, 2012.
(Continued)

*Primary Examiner* — Cassandra Davis
(74) *Attorney, Agent, or Firm* — Stanton IP Law Firm, P.A.

(57) ABSTRACT

The present application is directed to container and shrink label systems. The container may comprise multiple label locking features that hold a shrink label in place on a conically-shaped container. The system may further comprise an interactive promotional label system comprising multiple promotional elements that may be linked to complete a promotional event.

8 Claims, 30 Drawing Sheets

(51) Int. Cl.

| | |
|---|---|
| ***G09F 3/00*** | (2006.01) |
| ***G09F 3/04*** | (2006.01) |
| ***B65D 23/08*** | (2006.01) |
| ***B65D 23/14*** | (2006.01) |

(52) U.S. Cl.

CPC ..... *G09F 2003/021* (2013.01); *G09F 2003/0205* (2013.01); *G09F 2003/0213* (2013.01); *G09F 2003/0251* (2013.01); *G09F 2003/0272* (2013.01)

(56) References Cited

U.S. PATENT DOCUMENTS 1,054,826 A 3/1913 Cole
1,064,576 A 6/1913 Washburn
1,145,367 A 7/1915 Herter
1,312,611 A 8/1919 Chess
1,317,660 A 9/1919 Carlson
1,334,031 A 3/1920 Hahn
1,387,625 A 8/1921 Stein
1,486,313 A 3/1924 Van Antwerp
2,013,616 A 9/1935 Rettenmeyer
2,069,609 A 2/1937 Hanson
2,129,364 A 9/1938 Simons et al.
2,441,607 A 5/1948 Walls
2,450,949 A * 10/1948 Gattuccio ..... A61J 7/04 116/308
2,468,000 A 4/1949 Taylor
2,487,274 A 11/1949 Schaffer
2,504,076 A 4/1950 Lindblom
2,706,464 A 4/1955 North
2,738,564 A 3/1956 Guianne
2,739,564 A 3/1956 North
2,844,893 A 7/1958 Keller
2,860,431 A 11/1958 Barnum
2,931,657 A 4/1960 Lewis
2,935,814 A 5/1960 Freeze
2,971,283 A 2/1961 Parker
3,233,770 A 2/1966 Waters
3,278,182 A 10/1966 Lescher
3,374,911 A 3/1968 White
D210,767 S 4/1968 Anglada
3,375,954 A 4/1968 Honkanen et al.
3,468,467 A 9/1969 Amberg
3,488,880 A 1/1970 Taylor
3,523,623 A 8/1970 Dorn
3,542,229 A 11/1970 Beyerlein et al.
3,604,584 A 9/1971 Shank
3,633,781 A 1/1972 Zapata
3,733,002 A 5/1973 Fujio
3,750,317 A 8/1973 Morgan
3,766,882 A 10/1973 Babbitt, III
3,779,829 A 12/1973 Wolff
3,865,671 A 2/1975 Kronsder
3,874,977 A 4/1975 Pyles
3,960,713 A 6/1976 Carey
4,044,889 A 8/1977 Orentreich et al.
4,057,251 A 11/1977 Jones et al.
4,072,553 A 2/1978 Braker et al.
4,203,240 A 5/1980 Goodwin
4,312,523 A 1/1982 Haines
4,318,683 A 3/1982 Fishbaugh et al.
4,381,615 A 5/1983 Lonsmin
4,405,045 A 9/1983 Villa-Real
4,473,429 A 9/1984 Crankshaw
4,505,497 A 3/1985 Katzman
4,518,450 A 5/1985 Warmann
4,533,586 A 8/1985 Roule et al.
4,567,681 A 2/1986 Fumei
4,589,943 A 5/1986 Kimball et al.
4,658,974 A 4/1987 Fujita et al.
4,680,080 A 7/1987 Instance
4,700,976 A 10/1987 Loose
4,724,973 A 2/1988 Shah
4,727,667 A 3/1988 Ingle
4,732,411 A 3/1988 Siegel
4,844,760 A 7/1989 Dickey
4,877,119 A * 10/1989 Hosking ..... G01F 19/00 116/227
4,918,604 A 4/1990 Baum
4,920,912 A 5/1990 Kirkling
4,955,153 A 9/1990 Albrecht et al.
5,017,261 A 5/1991 Zodrow et al.
5,048,870 A 9/1991 Mangini et al.
5,062,917 A 11/1991 Zodrow
5,076,613 A 12/1991 Kovacs
5,078,826 A 1/1992 Rogall
5,116,452 A 5/1992 Eder
5,154,448 A 10/1992 Griffin et al.
D331,423 S 12/1992 Brussing
5,207,011 A 5/1993 Coulthard
5,209,367 A 5/1993 Van Musscher et al.
5,215,622 A 6/1993 Schmelzer
5,263,743 A 11/1993 Jones
5,264,265 A 11/1993 Kaufmann
5,284,363 A 2/1994 Gartner et al.
5,321,933 A 6/1994 Seifert et al.
5,324,559 A 6/1994 Brombacher
5,342,093 A 8/1994 Weernink
5,363,576 A 11/1994 Piana et al.
5,370,754 A 12/1994 Soloman
5,403,635 A 4/1995 Hoffman
5,403,636 A 4/1995 Crum
5,405,482 A 4/1995 Morrissette et al.
5,462,488 A 10/1995 McKillip
5,484,167 A 1/1996 Donaldson et al.
D368,234 S 3/1996 Dickinson et al.
5,525,383 A 6/1996 Witkowski
5,605,230 A 2/1997 Marino, Jr. et al.
5,605,730 A 2/1997 Treleaven
5,639,529 A 6/1997 Gozdecki et al.
D383,038 S 9/1997 Willbrandt
D386,947 S 12/1997 Lapierre et al.
5,712,021 A 1/1998 Hernandez
5,727,766 A 3/1998 Mayo
5,727,819 A 3/1998 Grosskopf et al.
5,738,382 A 4/1998 Grosskopf et al.
5,741,381 A 4/1998 Dolence et al.
5,758,096 A 5/1998 Barsky et al.
5,799,525 A 9/1998 Johnson et al.
5,800,893 A 9/1998 Harden
5,809,674 A * 9/1998 Key ..... B65D 23/0885 40/306
5,829,789 A 11/1998 Treleaven et al.
5,830,550 A 11/1998 Treleaven et al.
5,842,633 A 12/1998 Nurse
5,863,628 A 1/1999 Barry
5,883,370 A 3/1999 Walker et al.
5,884,421 A 3/1999 Key
5,953,170 A 9/1999 Glancy
5,975,582 A 11/1999 Treleaven
6,027,780 A 2/2000 Treleaven et al.
6,035,568 A 3/2000 Grosskopf et al.
6,047,488 A 4/2000 Tuszkiewicz
6,048,423 A 4/2000 Barrash et al.
6,057,019 A 5/2000 Barry
D428,307 S 7/2000 Yeandel
6,086,697 A 7/2000 Key
6,120,637 A 9/2000 Barry
6,129,802 A 10/2000 Key
6,129,959 A 10/2000 Mercer et al.
6,158,612 A 12/2000 Alpert
D436,499 S 1/2001 Pritchard et al.
6,212,803 B1 * 4/2001 Key ..... B65C 3/065 215/252
6,213,520 B1 4/2001 Treleaven et al.
6,237,269 B1 5/2001 Key
6,253,438 B1 7/2001 Jespersen
6,254,138 B1 7/2001 Rawlings et al.
6,258,200 B1 7/2001 Kassab
6,267,672 B1 7/2001 Vance
D446,687 S 8/2001 Furman et al.
6,270,121 B1 8/2001 Dolan et al.
6,274,236 B1 8/2001 Shacklett et al.

(56) References Cited

U.S. PATENT DOCUMENTS 6,276,533 B1 8/2001 Kaplan
6,328,832 B1 12/2001 Otruba et al.
6,329,034 B1 12/2001 Pendry et al.
6,360,462 B1 3/2002 Mengel
6,385,878 B1 * 5/2002 Key ..... G09F 3/0288 40/306
6,398,263 B2 6/2002 Treleaven et al.
6,402,872 B1 6/2002 Key
6,413,345 B1 7/2002 Treleaven
D461,369 S 8/2002 Sims et al.
6,428,639 B1 8/2002 Oldenburg et al.
6,431,241 B1 8/2002 Gonzalo
6,454,094 B1 9/2002 Salani
6,550,171 B1 4/2003 De Werra et al.
6,550,512 B2 4/2003 Yang
6,561,246 B2 5/2003 Yang
6,575,216 B2 6/2003 Yang
6,581,773 B2 6/2003 Kaplan
6,616,189 B2 9/2003 Raming
6,622,878 B1 9/2003 Frey
6,631,578 B2 10/2003 Key
6,649,007 B1 11/2003 Key
6,669,804 B2 12/2003 Pendry et al.
6,722,568 B2 4/2004 Blanford et al.
6,737,137 B2 5/2004 Franko, Sr. et al.
6,752,431 B1 6/2004 Matthews et al.
6,755,442 B2 6/2004 Franko, Sr. et al.
6,779,480 B2 8/2004 Zamjahn
6,786,515 B2 9/2004 Franko, Sr.
6,793,075 B1 9/2004 Jeter
6,793,755 B2 9/2004 Schaupp et al.
6,811,640 B2 11/2004 Franko, Sr.
6,904,867 B2 6/2005 Zamjahn
D526,847 S 8/2006 Freeman
7,087,298 B2 8/2006 Key
D527,583 S 9/2006 Freeman
D533,748 S 12/2006 Bresler
7,172,220 B2 2/2007 Franko, Sr.
7,172,668 B2 2/2007 Key
7,179,514 B2 2/2007 Olsen et al.
7,325,510 B2 2/2008 Giewercer
7,601,410 B2 10/2009 Matthews et al.
7,621,231 B2 11/2009 McNeely
7,628,427 B2 12/2009 Adler et al.
7,782,479 B2 8/2010 Handa et al.
7,875,142 B2 1/2011 Matthews et al.
7,926,851 B2 4/2011 Kaufman
8,037,628 B2 10/2011 Kaufman
8,043,993 B2 10/2011 Roth et al.
D649,396 S 11/2011 Wilkens et al.
8,096,415 B2 * 1/2012 Crosby ..... A45D 40/00 116/309
8,142,596 B1 3/2012 Valenti, Jr. et al.
8,245,752 B2 8/2012 Lingier et al.
8,272,562 B2 9/2012 Ziegler
8,413,884 B2 4/2013 Lim et al.
8,424,761 B2 4/2013 Yanagi
D682,088 S 5/2013 de Urquijo Carmona
8,709,198 B2 4/2014 Key
8,727,220 B2 5/2014 Key
D706,624 S 6/2014 Key
D706,625 S 6/2014 Key
2001/0004152 A1 6/2001 Treleaven et al.
2001/0017181 A1 8/2001 Otruba et al.
2001/0025442 A1 10/2001 Key
2001/0045741 A1 11/2001 Shacklett et al.
2001/0050242 A1 12/2001 Kaplan
2002/0015813 A1 2/2002 Pendry et al.
2002/0017784 A1 2/2002 Merry et al.
2002/0029635 A1 3/2002 Kremen
2002/0038685 A1 * 4/2002 Key ..... B65C 9/20 156/184
2002/0096261 A1 7/2002 Yang
2002/0096262 A1 7/2002 Yang
2002/0096264 A1 7/2002 Yang
2002/0104613 A1 * 8/2002 Key ..... B65C 9/20 156/268
2002/0139292 A1 8/2002 Giewercer
2002/0130182 A1 9/2002 Mondie
2002/0185212 A1 * 12/2002 Schaupp ..... B65C 9/06 156/205
2002/0193225 A1 12/2002 Raming
2003/0006606 A1 1/2003 Franko, Sr. et al.
2003/0012911 A1 1/2003 Campbell
2003/0015105 A1 1/2003 Dewig et al.
2003/0030270 A1 2/2003 Franko, Sr. et al.
2003/0091819 A1 5/2003 Franko, Sr.
2003/0118768 A1 6/2003 Sellars
2003/0137145 A1 7/2003 Fell et al.
2003/0175463 A1 9/2003 Olsen et al.
2003/0189490 A1 10/2003 Hogerton et al.
2003/0201064 A1 10/2003 Treleaven et al.
2004/0108237 A1 6/2004 McClintock
2004/0123565 A1 7/2004 Rice et al.
2004/0166277 A1 8/2004 Key
2004/0188998 A1 9/2004 Henthorn
2004/0197513 A1 10/2004 Shacklett et al.
2004/0207193 A1 10/2004 Franko, Sr.
2004/0247863 A1 12/2004 Scott
2005/0038558 A1 2/2005 Keene
2005/0056203 A1 3/2005 Giewercer
2005/0097004 A1 5/2005 Masse Blume
2005/0181165 A1 8/2005 Franko, Sr.
2005/0183982 A1 8/2005 Giewercer
2005/0190914 A1 9/2005 Chen et al.
2005/0209870 A1 9/2005 Alden
2006/0029761 A1 2/2006 Matthews et al.
2006/0032923 A1 2/2006 Krupa
2006/0078701 A1 4/2006 Glasier
2006/0145471 A1 7/2006 Franko, Sr.
2006/0249950 A1 11/2006 Kenney et al.
2007/0029787 A1 2/2007 Loftin, III et al.
2007/0034103 A1 2/2007 Kaufman
2007/0043530 A1 2/2007 O'Rourke
2007/0119542 A1 5/2007 Williams et al.
2007/0209753 A1 9/2007 Gonzalez et al.
2007/0209755 A1 9/2007 Smith
2007/0213214 A1 9/2007 Roth et al.
2007/0221319 A1 9/2007 Morgan
2007/0222205 A1 9/2007 Handa et al.
2007/0252379 A1 11/2007 Bethune et al.
2007/0299693 A1 12/2007 Jung et al.
2008/0003391 A1 1/2008 Franko et al.
2008/0003410 A1 1/2008 Shacklett et al.
2008/0010874 A1 1/2008 Londino
2008/0014344 A1 1/2008 Fort et al.
2008/0073902 A1 3/2008 Franko
2008/0121688 A1 5/2008 Harrop
2008/0176955 A1 7/2008 Heck et al.
2008/0208694 A1 8/2008 Baggott
2008/0233405 A1 9/2008 Dronzek, Jr.
2008/0303264 A1 12/2008 Kaufman
2008/0303265 A1 12/2008 Kaufman
2009/0236023 A1 9/2009 Lingier et al.
2009/0255623 A1 10/2009 Bagung et al.
2009/0265188 A1 10/2009 Lamy et al.
2009/0294521 A1 12/2009 de la Huerga
2009/0315315 A1 * 12/2009 Bolouri ..... B65D 23/085 283/56
2010/0043267 A1 2/2010 Sterling
2010/0044438 A1 2/2010 Chen et al.
2010/0084077 A1 4/2010 Matthews et al.
2010/0101681 A1 4/2010 Kramer et al.
2010/0228615 A1 9/2010 Hays
2010/0240133 A1 9/2010 Brivanlou et al.
2010/0295916 A1 11/2010 Kaufman
2010/0300599 A1 12/2010 Fort et al.
2010/0307947 A1 12/2010 Marden et al.
2011/0061802 A1 3/2011 Raming
2011/0151115 A1 6/2011 Lingier
2011/0153398 A1 * 6/2011 Tjhai ..... G06Q 30/02 705/14.14
2011/0169602 A1 7/2011 Gaffney
2011/0185606 A1 8/2011 Londino

(56) References Cited

U.S. PATENT DOCUMENTS

| | | | |
|---|---|---|---|
| 2011/0233095 | A1 | 9/2011 | Seidl |
| 2012/0006712 | A1 | 1/2012 | Kaplan et al. |
| 2012/0010299 | A1 | 1/2012 | Kaplan et al. |
| 2012/0037299 | A1 | 2/2012 | Baeta et al. |
| 2012/0085828 | A1 | 4/2012 | Ziegler |
| 2012/0118503 | A1 | 5/2012 | Lorence et al. |
| 2012/0125526 | A1 | 5/2012 | Key |
| 2012/0175336 | A1 | 7/2012 | Miller et al. |
| 2012/0268837 | A1 | 10/2012 | Rittenburg et al. |
| 2012/0279632 | A1 | 11/2012 | Lingier et al. |
| 2012/0292219 | A1 | 11/2012 | Terwilliger et al. |
| 2013/0025175 | A1 | 1/2013 | Key |
| 2013/0025529 | A1 | 1/2013 | Key |
| 2013/0026056 | A1 | 1/2013 | Key |
| 2013/0026747 | A1 | 1/2013 | Key |
| 2013/0033031 | A1 | 2/2013 | Key |
| 2013/0036634 | A1 | 2/2013 | Key |
| 2013/0036641 | A1 | 2/2013 | Key |
| 2013/0037619 | A1 | 2/2013 | Key |
| 2013/0043157 | A1 | 2/2013 | Key |
| 2013/0062239 | A1 | 3/2013 | Key |
| 2013/0129971 | A1 | 5/2013 | Key et al. |
| 2014/0076766 | A1 | 3/2014 | Key |
| 2014/0210198 | A1 | 7/2014 | Key |
| 2014/0224889 | A1 | 8/2014 | Key |

FOREIGN PATENT DOCUMENTS

| | | |
|---|---|---|
| AU | 723118 | 11/2000 |
| BE | 932891 | 4/2002 |
| BE | 1165378 | 9/2004 |
| CH | 932891 | 4/2002 |
| CH | 1165378 | 9/2004 |
| CN | 103890826 | 6/2014 |
| DE | 6711903.3-08 | 4/2002 |
| DE | 1165378 | 9/2004 |
| DK | 85214 | 3/1958 |
| DK | 932891 | 4/2002 |
| EP | 285514 | 10/1988 |
| EP | 932891 | 4/2002 |
| EP | 1165378 | 9/2004 |
| EP | 2742501 | 6/2014 |
| ES | 932891 | 4/2002 |
| FR | 965522 | 9/1950 |
| FR | 1114750 | 4/1956 |
| FR | 1347102 | 11/1963 |
| FR | 2460260 | 1/1981 |
| FR | 285514 | 10/1988 |
| FR | 2613519 | 10/1988 |
| FR | 2677786 | 12/1992 |
| FR | 932891 | 4/2002 |
| FR | 1165378 | 9/2004 |
| GB | 932891 | 4/2002 |
| HK | 1039770 | 5/2002 |
| HK | 1021056 | 7/2002 |
| IE | 932891 | 4/2002 |
| IE | 1165378 | 9/2004 |
| IT | 327286 | 7/1935 |
| IT | 932891 | 4/2002 |
| MX | 204456 | 9/2002 |
| MX | 225535 | 1/2005 |
| MX | 227727 | 5/2005 |
| NL | 932891 | 4/2002 |
| NZ | 334683 | 11/1999 |
| SE | 1565 | 7/1888 |
| SE | 932891 | 4/2002 |
| WO | WO98/19289 | 5/1998 |
| WO | WO00/48161 | 8/2000 |
| WO | WO2003017174 | 2/2003 |
| WO | WO2007020628 | 2/2007 |
| WO | WO2012071355 | 5/2012 |
| WO | WO2013015838 | 1/2013 |
| WO | WO2013015839 | 1/2013 |
| WO | WO2013016364 | 1/2013 |
| WO | WO2013016461 | 1/2013 |
| WO | WO2013019907 | 2/2013 |
| WO | WO2013022495 | 2/2013 |
| WO | WO2013022508 | 2/2013 |
| WO | WO2013023221 | 2/2013 |
| WO | WO2013025947 | 2/2013 |
| WO | WO2013039578 | 3/2013 |
| WO | WO2013043618 | 3/2013 |
| WO | WO2014047077 | 3/2014 |

OTHER PUBLICATIONS

International Search Report and Written Opinion dated May 23, 2012 in Patent Cooperation Treaty Application No. PCT/US2012/022610, filed Jan. 25, 2012.

International Search Report and Written Opinion dated Oct. 9, 2012 in Patent Cooperation Treaty Application No. PCT/US2012/048021, filed Jul. 24, 2012.

International Search Report and Written Opinion dated Oct. 23, 2012 in Patent Cooperation Treaty Application No. PCT/US2012/050643, filed Aug. 13, 2012.

International Search Report and Written Opinion dated Nov. 30, 2012 in Patent Cooperation Treaty Application No. PCT/US2012/055948, filed Sep. 18, 2012.

International Search Report and Written Opinion dated Jul. 26, 2012 in Patent Cooperation Treaty Application No. PCT/US2012/037395, filed May 10, 2012.

International Search Report and Written Opinion dated Oct. 16, 2012 in Patent Cooperation Treaty Application No. PCT/US2012/048201, filed Jul. 25, 2012.

International Search Report and Written Opinion dated Jul. 9, 2012 in Patent Cooperation Treaty Application No. PCT/US2012/031670, filed Mar. 30, 2012.

International Search Report and Written Opinion dated Oct. 23, 2012 in Patent Cooperation Treaty Application No. PCT/US2012/051228, filed Aug. 16, 2012.

International Search Report and Written Opinion dated Oct. 16, 2012 in Patent Cooperation Treaty Application No. PCT/US2012/049234, filed Aug. 1, 2012.

International Search Report and Written Opinion dated Aug. 27, 2012 in Patent Cooperation Treaty Application No. PCT/US2012/040301, filed May 31, 2012.

Newswire, "AccuDial(R) Pharmaceutical, Inc. can put an end to underdosing and overdosing with new line of children's over-the-counter medications", Jul. 8, 2010 [retrieved Dec. 12, 2013]. Retrieved from Internet: <http://www.newswire.ca/en/story/646945/accudial-r-pharmaceutical-inc-can-put-an-end-to-underdosing-and-overdosing-with-new-line-of-children-s-over-the-counter-medications>.

Accudial Pharmaceutical, Inc. company website, www.accuratedose.com, Oct. 30, 2010 (Oct. 30, 2010) [retrieved Aug. 7, 2012). Retrieved from Internet: <http://web.archive.org/web/20101030115353/http://www.accuratedose.com.ca_english/home>.

Anonymous, "Chest congestion (guaifenesin) liquid", Internet article, http://dailymed.nlm.nih.gov/dailymed/druginfo.cfm?id=25295., (Oct. 26, 2009).

Anonymous, "Pharmaceutical & medical packaging news", The packaging magazine for the healthcare industry, 16: 12:76-78, Internet article, http://www.accuratedose.com/corporate/assets/pdf/PMP_MagReprinIDec08.pdf, (Dec. 12, 2008).

A. Abramson, "Start-up has twist on safe doses for kids", Internet article, http://www.accuratedose.com/corporate/assets/pdf/50840_ACC_PBP_Article.pdf, (Jul. 27, 2009).

Anonymous, "Chest congestion guaifenesin oral solution expectorant", Internet article, http://accuratedose.com/us_english/producUnformation/chest_congestion.html, (Aug. 24, 2011).

International Search Report and Written Opinion dated Apr. 2, 2012 in Patent Cooperation Treaty Application No. PCT/US2011/061739, filed Nov. 21, 2011.

International Search Report and Written Opinion dated Feb. 28, 2014 in Patent Cooperation Treaty Application No. PCT/US2013/060220, filed Sep. 17, 2013.

Non-final office action dated Oct. 21, 2003 in U.S. Appl. No. 10/005,428, filed Dec. 3, 2001.

(56) References Cited

OTHER PUBLICATIONS

Final office action dated Apr. 1, 2004 in U.S. Appl. No. 10/005,428, filed Dec. 3, 2001.
Advisory action dated Jul. 15, 2004 in U.S. Appl. No. 10/005,428, filed Dec. 3, 2001.
Advisory action dated Aug. 24, 2004 in U.S. Appl. No. 10/005,428, filed Dec. 3, 2001.
Non-final office action dated Mar. 31, 2005 in U.S. Appl. No. 10/005,428, filed Dec. 3, 2001.
Notice of allowance dated Oct. 19, 2005 in U.S. Appl. No. 10/005,428, filed Dec. 3, 2001.
Non-final office action dated Dec. 21, 2005 in U.S. Appl. No. 10/005,428, filed Dec. 3, 2001.
Notice of allowance dated Apr. 18, 2006 in U.S. Appl. No. 10/005,428, filed Dec. 3, 2001.
Non-final office action dated Mar. 28, 2005 in U.S. Appl. No. 10/764,403, filed Jan. 23, 2004.
Non-final office action dated Sep. 20, 2005 in U.S. Appl. No. 10/764,403, filed Jan. 23, 2004.
Final office action dated May 9, 2006 in U.S. Appl. No. 10/764,403, filed Jan. 23, 2004.
Notice of allowance dated Sep. 28, 2006 in U.S. Appl. No. 10/764,403, filed Jan. 23, 2004.
Non-final office action dated Jun. 3, 2013 in U.S. Appl. No. 13/169,651, filed Jun. 27, 2011.
Non-final office action dated Jan. 31, 2013 in U.S. Appl. No. 13/301,746, filed Nov. 21, 2011.
Final office action dated Aug. 20, 2013 in U.S. Appl. No. 13/301,746, filed Nov. 21, 2011.
Notice of allowance dated Dec. 2, 2013 in U.S. Appl. No. 13/301,746, filed Nov. 21, 2011.
Non-final office action dated Jun. 6, 2013 in U.S. Appl. No. 13/358,466, filed Jan. 25, 2012.
Notice of allowance dated Mar. 28, 2014 in U.S. Appl. No. 13/358,466, filed Jan. 25, 2012.
Non-final office action dated Oct. 8, 2013 in U.S. Appl. No. 13/358,470, filed Jan. 25, 2012.
Notice of allowance dated Apr. 16, 2014 in U.S. Appl. No. 13/358,470, filed Jan. 25, 2012.
Non-final office action dated Feb. 26, 2014 in U.S. App. No. 13/469,026, filed May 10, 2012.
Non-final office action dated Feb. 27, 2014 in U.S. Appl. No. 13/485,795, filed May 31, 2012.
Non-final office action dated Aug. 20, 2013 in U.S. Appl. No. 13/557,143, filed Jul. 24, 2012.
Final office action dated Jan. 28, 2014 in U.S. Appl. No. 13/557,143, filed Jul. 24, 2012.
Final office action dated May 2, 2014 in U.S. Appl. No. 13/557,143, filed Jul. 24, 2012.
Non-final office action dated Aug. 22, 2013 in U.S. Appl. No. 13/564,689, filed Aug. 1, 2012.
Final office action dated Dec. 2, 2013 in U.S. Appl. No. 13/564,689, filed Aug. 1, 2012.
Non-final office action dated May 30, 2014 in U.S. Appl. No. 13/564,689, filed Aug. 1, 2012.
Non-final office action dated Jan. 10, 2013 in U.S. Appl. No. 13/584,701, filed Aug. 13, 2012.
Final office action dated Aug. 12, 2013 in U.S. Appl. No. 13/584,701, filed Aug. 13, 2012.
Non-final office action dated May 12, 2014 in U.S. Appl. No. 13/584,701, filed Aug. 13, 2012.
Non-final office action dated Apr. 17, 2014 in U.S. Appl. No. 13/622,312, filed Sep. 18, 2012.
Non-final office action dated Sep. 23, 2013 in U.S. Appl. No. 29/455,598, filed May 22, 2013.
Notice of allowance dated Jan. 22, 2014 in U.S. Appl. No. 29/455,598, filed May 22, 2013.
Notice of allowance dated Apr. 15, 2014 in U.S. Appl. No. 29/455,598, filed May 22, 2013.
Non-final office action dated Sep. 20, 2013 in U.S. Appl. No. 29/455,599, filed May 22, 2013.
Notice of allowance dated Jan. 17, 2014 in U.S. Appl. No. 29/455,599, filed May 22, 2013.

* cited by examiner

CONTAINER WITH ROTATING SHRINK LABEL LOCKING FEATURES AND PROMOTIONAL LABEL SYSTEM

CROSS-REFERENCE TO RELATED APPLICATIONS

The present application claims priority to provisional U.S. Patent Application Ser. No. 61/824,845, filed on May 17, 2013, titled "Conical Shaped Cup or Container with Interlocking Shrink Label Holding Mechanism and Method of Constructing Same" and provisional U.S. Patent Application Ser. No. 61/832,455, filed on Jun. 7, 2013, titled "Rotatable Label Device Including a Game, Contest, and/or Game Piece Promotion and the Interaction Between Said Pieces," which are hereby incorporated by reference in their entirety.

FIELD OF THE INVENTION

The present application is directed generally to labels, and more specifically to shrink labels for consumer product containers that conform and rotate about non-parallel sides of the container and interactive promotional label systems.

BACKGROUND

Containers for consumer products have a limited amount of outer surface area for placement of labels on the container. This may pose a challenge to manufacturers of these consumer products to fit all of the information they want to deliver to the consumer, or are required by law to deliver to the consumer, in this limited area. Additional challenges may be presented by containers designed and produced with a contoured shape comprising concave, convex, or other non-parallel surfaces where the labels are to be placed. Standard flat labels such as pressure sensitive, roll fed, or cut and stack labels cannot typically be affixed to these non-parallel surfaces without buckling, creasing, or tearing because they require a flat labeling surface.

Conically-shaped cups or containers used for dispensing food and beverages are common in today's society. In the United States alone, about 16 billion paper cups and 25 billion foam cups are used each year. The fast food industry in particular is a large user of conically-shaped cups, mostly for beverages. However, these cups are also used as containers for non-liquid food items and are seeing use as take-out containers that fit in an automobile cup holder. Typically, cups provided by fast food establishments are printed with graphics and indicia on the outside of the cup advertising the establishment or company.

Current shrink labels on conically-shaped cups and containers have a tendency to ride up the side of the cup during application (placing the shrink label around the cup and then applying heat to shrink the label to conform to the cup). Shrink labels on conically-shaped cups and containers also have a tendency to slip off when the cup or container is used by the consumer. The conical shape of the cup or container, with a wide top and narrow bottom, lends itself to allowing the shrink label to slip off or ride up. This can pose problems to manufacturers applying a full body shrink label to this type of cup or container. Further, when a rotatable shrink label is employed, proper positioning of the label on the cup or container may be required, as well as maintaining this position while the label is rotated.

Contest and games are a common form of promotion used by fast food restaurants, convenience stores, theme parks, movie theaters, concerts, airlines, and other businesses that sell consumer packaged goods and desire to attract customers via the promotion. These promotions are commonly used in the soda, ready to drink product, and consumer packaged goods markets that use conically-shaped cups or containers to dispense these products. The promotions make take many forms, such as peel off labels, scratch off areas, random codes, and the like. Industries other than the food industry may also use these contests and games, such as automotive, health and beauty, pharmaceutical, household products, and many others.

These promotions often lack any type of interaction between the game piece or other promotional material and the label on the cup or container (or the cup or container itself). The game pieces and other promotional material is often printed or placed on the cup or container and the consumer must visit a web site or read separate printed material to learn information about the game or promotion. The separate printed material may increase the overall cost of the promotion, which could be viewed as a disadvantage to the company conducting the promotion. The addition of prizes that can be won, contest rules, game instructions, and the like to the label system could help entice a consumer to purchase the product, thus increasing sales and possible reducing the overall cost of the promotion.

SUMMARY

The present application is directed to container and shrink label systems. An exemplary container and shrink label system may comprise a conically-shaped container having a top edge and a bottom edge, and a continuous side wall disposed between the top edge and the bottom edge. A first label locking feature may be formed into the side wall circumferentially around the container in proximity to the top edge. A second label locking feature may be formed into the side wall circumferentially around the container and spaced apart from the first label locking feature. A shrink label having an upper border and a lower border may be positioned around the side wall of the container such that the label upper border is in contact with and conforms to the first label locking feature, and the label lower border is in contact with and conforms to the second label locking feature.

According to additional exemplary embodiments, the present application may be directed to an interactive promotional label system for a container. The interactive promotional label system may comprise three interactive promotional elements coupled to the container. The first promotional element may comprise one or more indicia or other promotional material printed or otherwise coupled to an outer surface of the container. The second promotional element may comprise a rotatable top shrink label covering at least a portion of the outer surface of the container, the rotatable top shrink label having indicia or other promotional material printed thereon. The third promotional element may comprise a game piece or other indicia that links with either or both of the first and second promotional elements to complete a promotional event. A transparent window may be placed within a portion of the rotatable top shrink label, the transparent window allowing at least a portion of the first promotional element to be visible through the transparent window.

According to still further exemplary embodiments, the present application may be directed to a promotional label system for a container. The promotional label system may comprise a conically-shaped container having a top edge and a bottom edge, and a continuous side wall disposed between the top edge and the bottom edge. The interactive promotional label system may further comprise three interactive promotional elements coupled to the container. The first promotional element may comprise one or more indicia or other promotional material printed or otherwise coupled to an outer surface of the container. The second promotional element may comprise a rotatable top shrink label covering at least a portion of the outer surface of the container, the rotatable top shrink label having indicia or other promotional material printed thereon. The third promotional element may comprise a game piece or other indicia that links with either or both of the first and second promotional elements to complete a promotional event. A transparent window may be placed within a portion of the rotatable top shrink label, the transparent window allowing at least a portion of the first promotional element to be visible through the transparent window. A first label locking feature may be formed into the side wall circumferentially around the container in proximity to the top edge. A second label locking feature may be formed into the side wall circumferentially around the container and spaced apart from the first label locking feature.

According to yet other exemplary embodiments, the present application may be directed to methods for producing an interactive promotional label system for a container. An exemplary method may comprise forming a conically-shaped container having a top edge and a bottom edge, and a continuous side wall disposed between the top edge and the bottom edge. A first label locking feature may be formed into the side wall circumferentially around the container in proximity to the top edge of the container. A second label locking feature may be formed into the side wall circumferentially around the container and spaced apart from the first label locking feature. A first promotional element may be printed or otherwise coupled onto an outer surface of the side wall, the first promotional element comprising indicia or other promotional material. A second promotional element may be coupled to the outer surface of the side wall, the second promotional element comprising a rotatable top shrink label having indicia or other promotional material printed thereon. An upper border of the rotatable top shrink label may contact and conform to the first label locking feature. A lower border of the rotatable top shrink label may contact and conform to the second label locking feature. A third promotional element may be coupled to the container, the third promotional element comprising a game piece or other indicia or promotional material that links with either or both of the first and second promotional elements to complete a promotional event. A transparent window may be placed within a portion of the rotatable top shrink label, the transparent window allowing at least a portion of the first promotional element to be visible through the transparent window.

DETAILED DESCRIPTION

The present application is directed to container and shrink label systems. An exemplary container and shrink label system may comprise a conically-shaped container having a top edge and a bottom edge, and a continuous side wall disposed between the top edge and the bottom edge. A first label locking feature may be formed into the side wall circumferentially around the container in proximity to the top edge. A second label locking feature may be formed into the side wall circumferentially around the container and spaced apart from the first label locking feature. A shrink label having an upper border and a lower border may be positioned around the side wall of the container such that the label upper border is in contact with and conforms to the first label locking feature, and the label lower border is in contact with and conforms to the second label locking feature.

Figure 1:
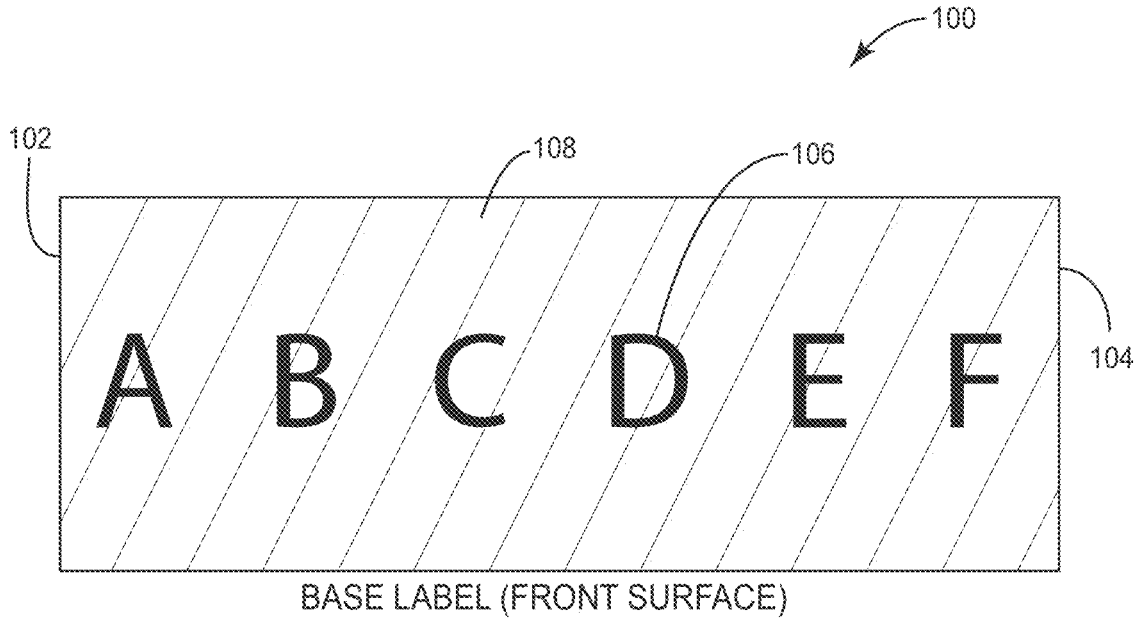
FIG. 1 is a front view of an exemplary label according to various embodiments.

FIG. 1 illustrates various embodiments of a front surface 108 of a base label 100 for an object, such as a medication container, according to various embodiments. The base label 100 comprises a leading edge 102 and a trailing edge 104. While the leading edge 102 is oriented to the left and the trailing edge is oriented to the right as presented in FIG. 1, the orientation of the leading edge 102 and the trailing edge 104 could be reversed depending on which edge is first applied to the object. Both orientations are within the scope of the present disclosure. Base label front surface 108 may comprise writing or other indicia 106 thereon.

As used herein, the leading edge refers to the first edge to be affixed to the object and the trailing edge refers to the second edge to be affixed to the object or the overlapping leading edge. Depending on the orientation of the label and the object when the label is affixed to the object, either edge of the label may be the leading edge. The orientations presented in the figures are for convenience and are not intended to be limiting in any way.

Figure 2:
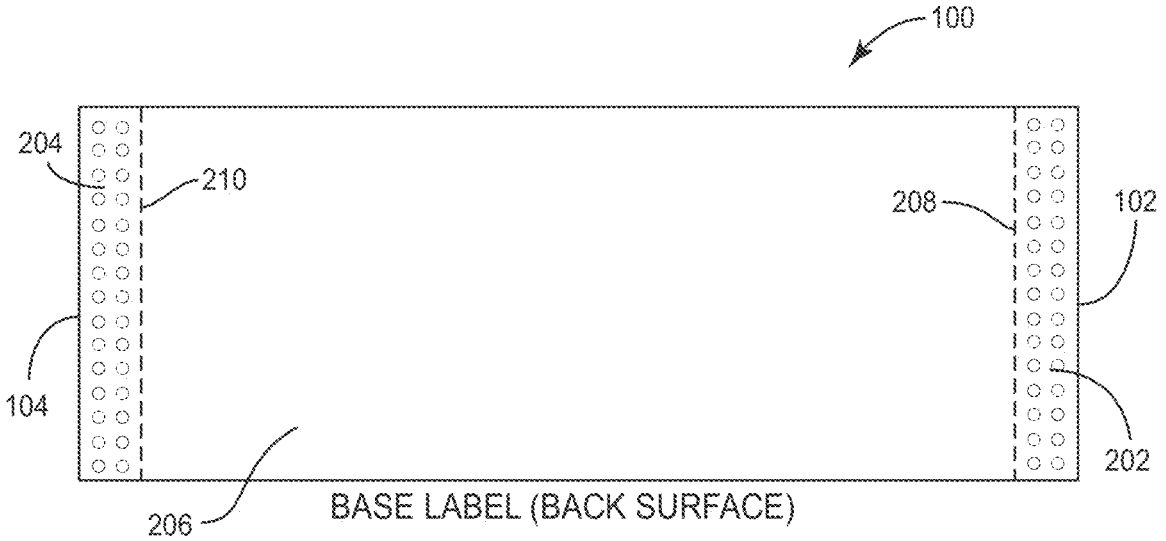
FIG. 2 is a back view of an exemplary label according to various embodiments.

FIG. 2 illustrates various embodiments of a back surface 206 of the base label 100. In various embodiments, the base label back surface 206 comprises two strips of adhesive 202 and 204 on or immediately adjacent to the leading and trailing edges, 102 and 104, respectively. Base label leading edge adhesive 202 may have a boundary 208 defined as its limit on the base label back surface 206. Base label trailing edge adhesive 204 may also have a boundary 210. While FIG. 2 illustrates that the adhesive strips 202 and 204 are generally close to the base label leading and trailing edges 102 and 104, respectively, it is understood that the adhesive strips 202 and 204 may be continuous or discontinuous, and may extend across any portion of the base label back surface 206, including the entire base label back surface 206. In various embodiments, a length of the base label 100 may be selected to be slightly longer than a circumference of the object on which it is placed, such that the trailing edge 104 overlaps the leading edge 102, and the trailing edge 104 is affixed to the leading edge 102. In various embodiments, the length of the base label 100 may be selected to be approximately the same as the circumference of the object on which it is placed, such that the leading edge 102 and the trailing edge 104 do not overlap.

Figure 3:
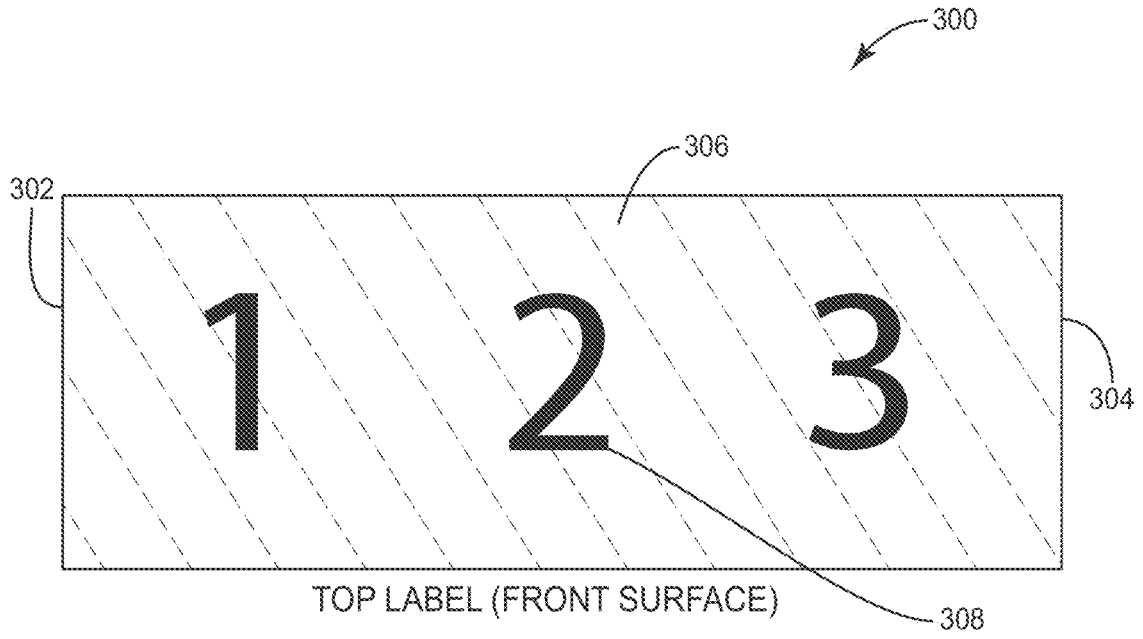
FIG. 3 is a front view of an exemplary label according to various embodiments.

FIG. 3 illustrates various embodiments of a front surface 306 of a top label 300. Top label 300 comprises a leading edge 302 and a trailing edge 304, and indicia 308 may be imprinted on the top label front surface 306.

Figure 4:
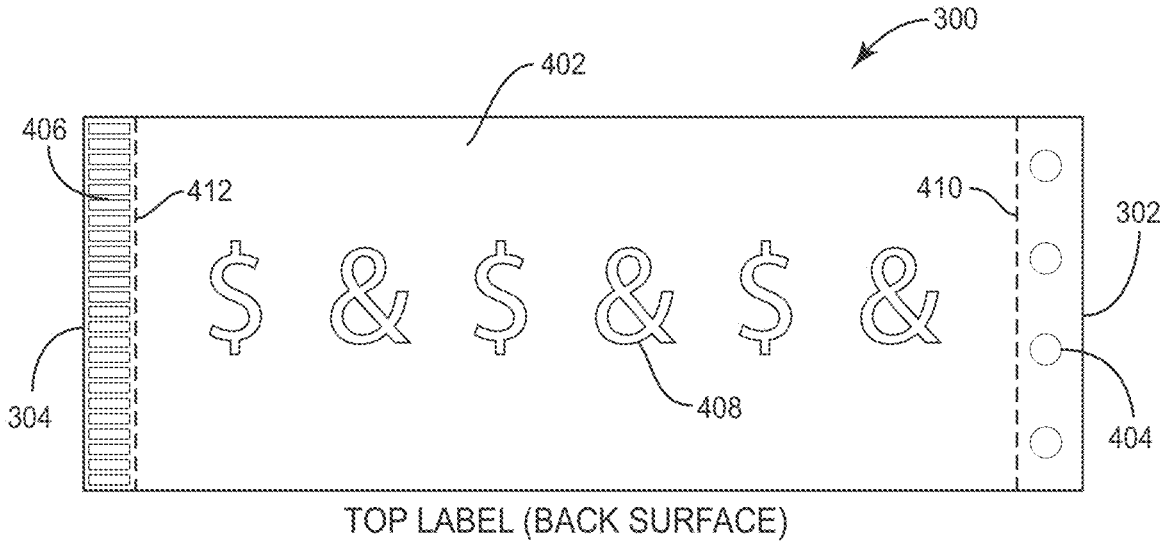
FIG. 4 is a back view of an exemplary label according to various embodiments.

Various embodiments of a back surface 402 of the top label 300 are illustrated in FIG. 4. The top label back surface 402 may comprise various indicia 408 printed thereon, as well as two strips of adhesive 404 and 406 on or immediately adjacent to the leading and trailing edges, 302 and 304, respectively. Top label leading edge adhesive 404 may have a boundary 410 defined as its limit on the top label back surface 402. Top label trailing edge adhesive 406 may also have a boundary 412. While FIG. 4 illustrates that the adhesive strips 404 and 406 are generally close to the top label leading and trailing edges 302 and 304, respectively, it is understood that the adhesive strips 404 and 406 may be continuous or discontinuous, and may extend across any portion of the top label back surface 402, including the entire top label back surface 402. In various embodiments, the adhesive strips 404 and 406 are confined to areas near the leading and trailing edges 302 and 304, respectively, so as not to obscure or interfere with the top label back surface indicia 408.

The base label adhesive 202, 204 and the top label adhesive 404, 406 may be applied in a variety of patterns as can be appreciated by one skilled in the art. The adhesive 202, 204, 404, 406 may be applied in strips, dots, droplets, circles, rectangles, squares, triangles, lines, and the like, as well as combinations of patterns.

A length of the top label 300 may be selected to be slightly longer than a circumference of the object on which it is placed, such that the top label trailing edge 304 overlaps the top label leading edge 302, and the top label trailing edge 304 is affixed to the top label leading edge 302. In various embodiments, the length of the top label 300 may be selected to be approximately the same as the circumference of the object on which it is placed, such that both the leading edge 302 and the trailing edge 304 do not overlap and are affixed to the base label front surface 108.

Figure 5A:
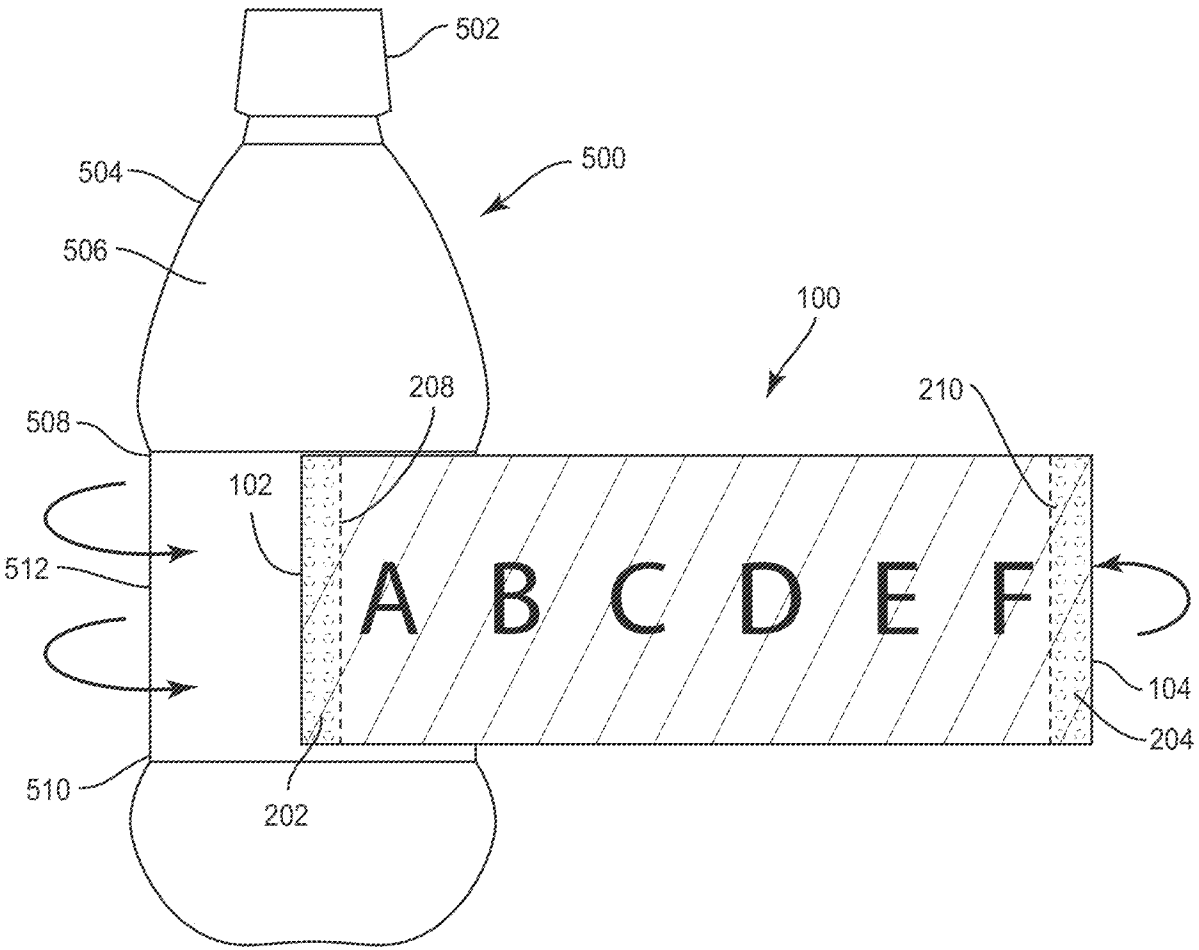
FIG. 5A illustrates a leading edge of an exemplary label affixed to a container according to various embodiments.

FIG. 5A illustrates the application of the base label 100 to an exemplary container 500 according to various embodiments. The container 500 may be a glass or plastic bottle, or other type of container such as a metal can or a cardboard receptacle. The container may be round, rectangular, square, or any other shape known in the art. The term "container" is used here for convenience to describe exemplary embodiments. It is understood that the container may be any object, including non-containers. Container 500 may comprise a cap 502 removably secured to a body 504. Various embodiments of the body 504 may have an exterior surface 506 that comprises a upper label panel 508, a lower label panel 510, and a recessed surface 512 interposed between the upper label panel 508 and the lower label panel 510. As discussed below, the base label 100 may be applied to the container 500 at the recessed area 512 between the upper label panel 508 and the lower label panel 510.

In various embodiments, the top label 300 may be rotatable about the base label 100, as discussed below. In these embodiments, the upper label panel 508 and lower label panel 510 may function to restrict upward and downward movement of the top label 300 in relation to the container 500 such that the top label 300 generally remains in a position covering at least a portion of the base label 100.

Figure 5B:
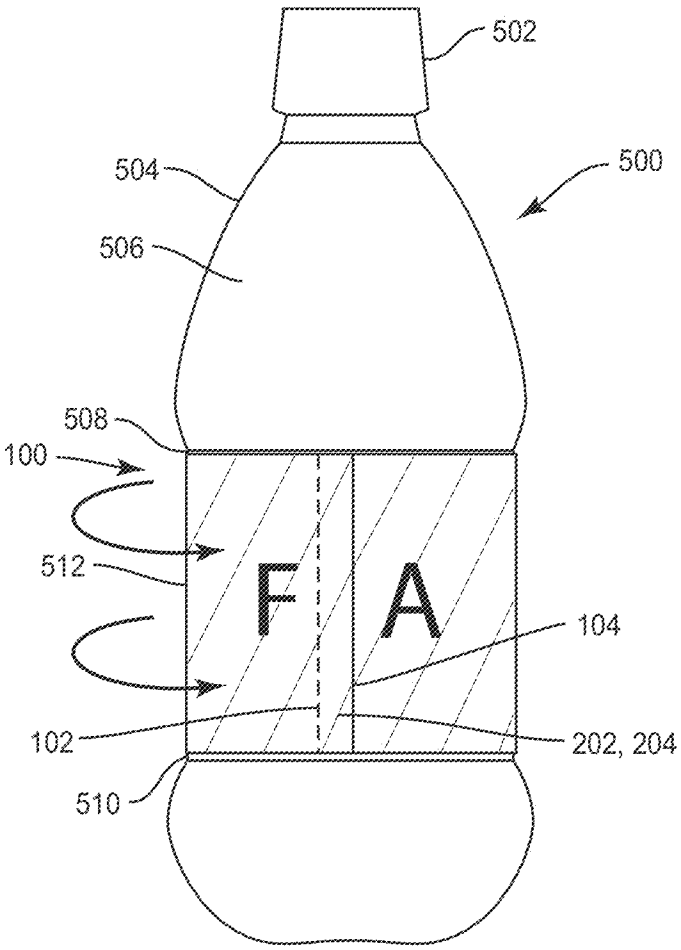
FIG. 5B illustrates an exemplary label secured about a container according to various embodiments.

FIG. 5B illustrates the container 500 with the base label 100 affixed to the container 500. Initially, as illustrated in FIG. 5A, base label leading edge 102 is placed in contact with the recessed surface 512 of the container 500 and affixed to the container 500 by the leading edge adhesive strip 202. With relative motion between the container 500 and the base label 100, the base label 100 may be wrapped around the container 500 with the base label trailing edge 104 now overlapping the base label leading edge 102 such that the leading edge adhesive strip 202 holds the base label leading edge 102 to the container 500 while the trailing edge adhesive strip 204 holds the base label trailing edge 104 to the overlapped base label leading edge 102.

Figure 6:
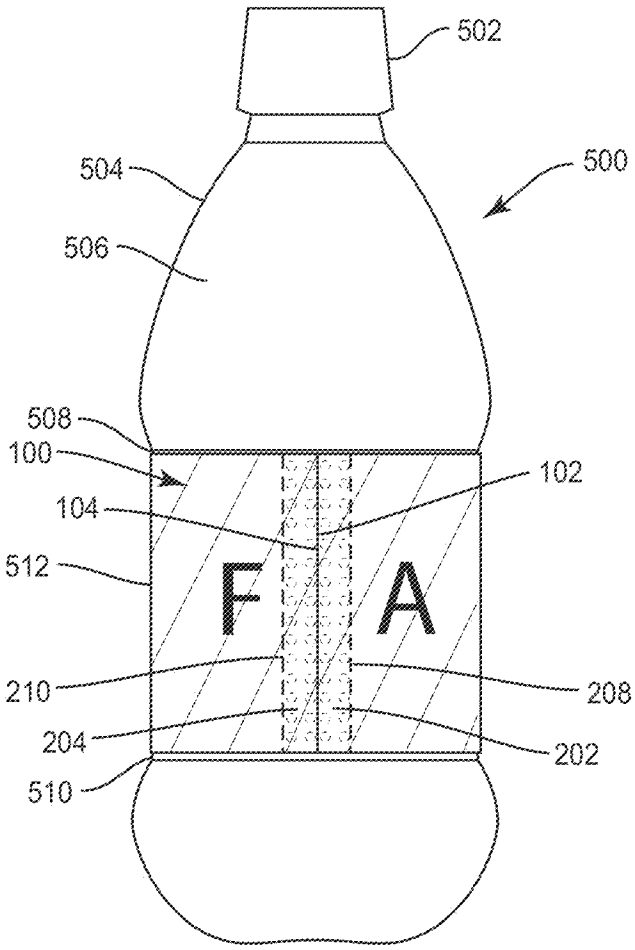
FIG. 6 illustrates an exemplary label secured about a container according to various embodiments.
Figure 7:
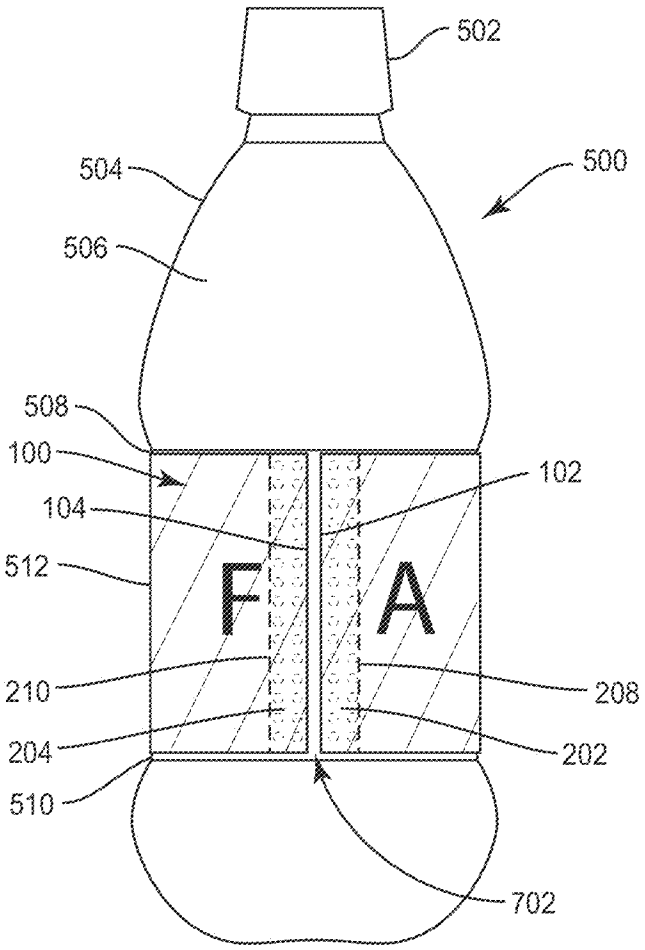
FIG. 7 illustrates an exemplary base label secured about a container according to various embodiments.

In various embodiments as illustrated in FIG. 6, the length of the base label 100 may be substantially the same as a circumference of the recessed surface 512 of the container 500, which may allow the base label leading edge 102 and base label trailing edge 104 to abut rather than overlap. However, it is also possible that the length of the base label 100 may be shorter than the circumference of the recessed surface 512, resulting in a gap 702 between the base label leading edge 102 and the base label trailing edge 104 when the base label 100 is affixed to the recessed surface as illustrated in FIG. 7. In both of these instances, the base label trailing edge adhesive strip 204 may adhere to the recessed surface 512 of the container 500, rather than the base label leading edge 102.

In various embodiments, the base label adhesive strips 202, 204 may comprise a permanent adhesive. In general, a permanent adhesive is one that does not readily release from a surface to which it adheres after the adhesive dries or cures. Using the base label 100 as an example, the permanent adhesive 202, 204 will tend not to release from the recessed surface 512, nor will it tend to release the base label leading edge 102 or trailing edge 104 once dried or cured. In order to remove the base label from the recessed surface 512, the base label 100 may have to be torn from the adhesive, or the adhesive layer 202, 204 may have to be fractured which may leave some of the adhesive on the recessed surface 512 and some of the adhesive on the base label leading edge 102 or trailing edge 104. Once the surfaces affixed with the permanent adhesive are separated, they may not be reattached.

Figure 8:
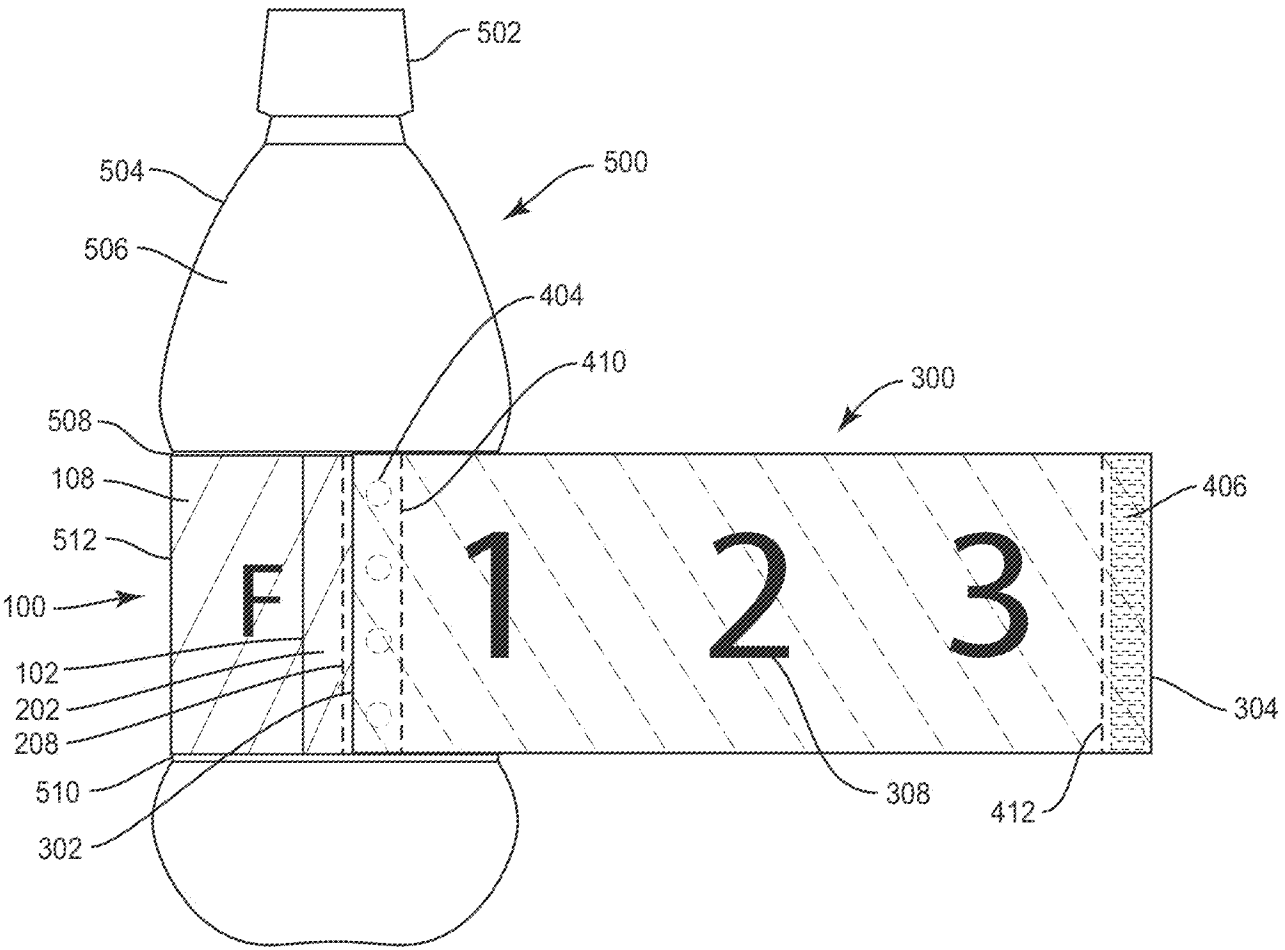
FIG. 8 illustrates a leading edge of an exemplary top label affixed to an exemplary base label according to various embodiments.

In FIG. 8, the base label 100 is already affixed to the recessed surface 512 of the container 500, and the application of the top label 300 over the base label 100 is illustrated according to various embodiments. The top label leading edge 302 may be placed in contact with any portion of the base label front surface 108 and affixed to the base label front surface 108 by the top label leading edge adhesive strip 404. With relative motion between the container 500 and the top label 300, the top label 300 may be wrapped around the container 500 with the top label trailing edge 304 now overlapping the top label leading edge 302 such that the top label leading edge adhesive strip 404 holds the top label leading edge 302 to the base label 100 while the top label trailing edge adhesive strip 406 holds the top label trailing edge 304 to the overlapped top label leading edge 302.

Figure 9:
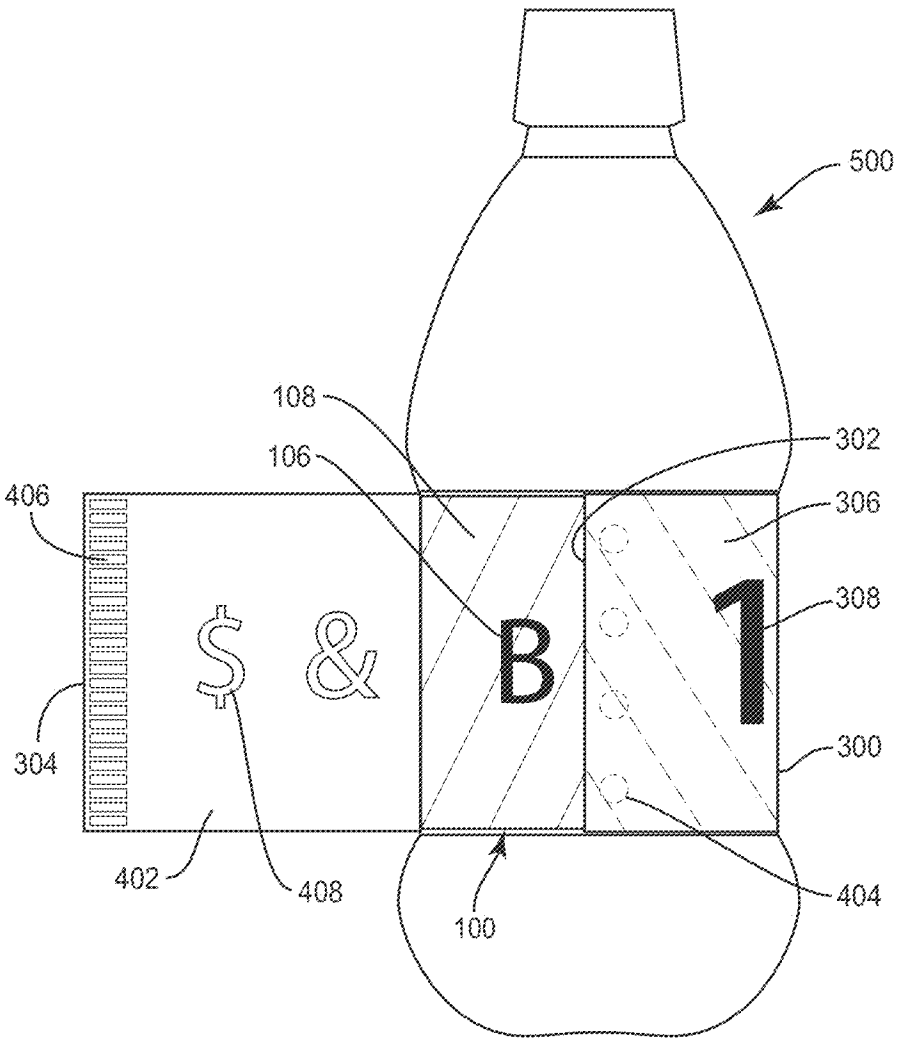
FIG. 9 illustrates an exemplary top label affixed to an exemplary base label and partially wrapped about a container according to various embodiments.

FIG. 9 illustrates the operation of the base label 100 and the top label 300 according to various embodiments. Beginning with the container 500 with the base label 100 and the top label 300 in place as shown, for example, in FIG. 6, the top label trailing edge 304 may be detached from the top label leading edge 302 and at least partially peeled back as shown in FIG. 9. The combination of the base label 100 and the top label 300 in this configuration increases the amount of surface area available for viewing by a consumer or user of the container 500. Prior to detaching the top label trailing edge 304, the consumer may view the top label front surface 306. Upon detaching the top label trailing edge 304, the consumer may now view the top label back surface 402 and the base label front surface 108 in addition to the top label front surface 306.

One of at least three types of adhesive may be used for the top label leading edge adhesive 404. A first type of adhesive is the permanent adhesive as described above for the base label 100. When a permanent adhesive is used for the top label leading edge adhesive 404, the top label leading edge generally cannot be detached without inflicting damage to one or both of the top label 300 or the base label 100. This may be desirable for various embodiments where the top label 300 is not intended to be removed from the container 500.

A second type of adhesive that may be used for the top label leading edge adhesive 404 is a releasable adhesive. A releasable adhesive is one that will release from a surface to which it is attached once a sufficient mechanical force is applied. A releasable adhesive may be used, for example, when the top label back surface 402 comprises a coupon for a subsequent purchase of a product. The releasable adhesive may allow the consumer to easily remove the top label 300 for later use. In various embodiments, the releasable adhesive may be a breakaway adhesive. A breakaway adhesive may have limited ability to withstand shear stresses. Shear stresses may cause the adhesive bond created between the label (e.g., top label 300) and the surface to which it is affixed (e.g., the base label 100 or container 500) to fail along the adhesive. In general, a releasable or breakaway adhesive may not re-attach to a surface once removed.

A third type of adhesive that may be used for the top label leading edge adhesive 404 is a resealable adhesive. A resealable adhesive may release from a surface to which it is attached once a sufficient mechanical force is applied, similar to the releasable adhesive described above. However, the resealable adhesive may be re-attached to a surface by applying pressure. A resealable adhesive may be desirable when the top label back surface 402 or the base label front surface 108 comprise information that may be needed only on occasion. Thus, the consumer or user may detach the top label 300 when the information is needed, then re-attach the top label 300.

In various embodiments, the top label trailing edge adhesive 406 may be a releasable adhesive or a resealable adhesive, depending on the intended use of the top label 300. As described above, if the surfaces 108, 402 comprise information that is intended to stay with the container, the top label trailing edge adhesive 406 may be a resealable adhesive. In contrast, if the top label 300 is intended to be removed from the container 500, a releasable adhesive may be desirable.

Figure 10:
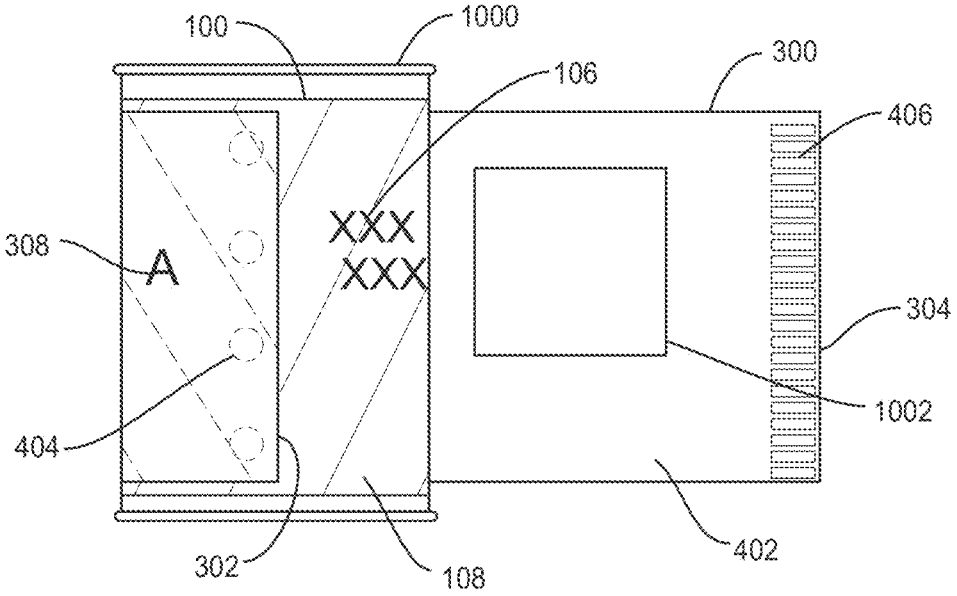
FIG. 10 illustrates an exemplary top label with a window affixed to an exemplary base label and partially wrapped about a container according to various embodiments.

FIG. 10 illustrates various embodiments of the top label 300 comprising a window 1002. The window 1002 may comprise a void in the top label 300 such that a portion of the base label 100 may be visible through the window. In various embodiments, the window 1002 may have a transparent covering (not shown). In various other embodiments, the window may comprise a transparent section of the top label 300 itself rather than a void. FIG. 10 illustrates the top label 300 partially wrapped about a container 1000, and base label 100 already in place on the container 1000. As shown, the top label leading edge adhesive 404 maintains the top label 300 coupled to the base label 100. The top label 300 may then be moved from the position illustrated in FIG. 10 to the position illustrated in FIG. 11 to secure the top label 300 about the container 1000. Top label trailing edge adhesive 406 may couple to the top label leading edge 302 if the top label leading edge 302 and trailing edge 304 overlap; otherwise, the top label trailing edge adhesive 406 may be coupled to the base label front surface 108.

Figure 11:
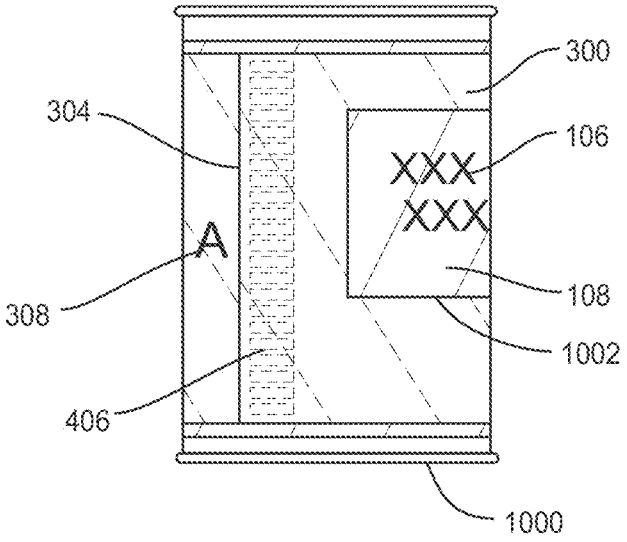
FIG. 11 illustrates an exemplary top label with a window secured about a container and a portion of a base label visible through the window according to various embodiments.

Once the top label 300 is in position on the container 1000 as illustrated in FIG. 11, at least a portion of the base label front surface indicia 106 may be visible through the window 1002. This may allow viewing of a first portion of the base label 100 without removing the top label 300. In various embodiments, the top label leading edge adhesive 404 may be a breakaway adhesive. Rotation of the top label 300 relative to the base label 100 may exert shear stresses on the breakaway adhesive, causing the adhesive bond affixing the top label leading edge 302 to the base label 100 to fail. The top label 300 may then be freely rotatable about the base label 100, and a second portion of the base label 100 may be visible when the top label 300 is rotated to a second position. The window 1002 may be rectangular as illustrated in FIGS. 10 and 11, or any other shape as needed for a particular application. For example, the window 1002 may be a slit that reveals an alphanumeric string on the base label 100. In various embodiments, the top label 300 may comprise more than one window 1002. Various embodiments in which the top label trailing edge adhesive 406 is a resealable or releasable adhesive may allow the top label 300 to be peeled back to reveal the top label back surface 402 and essentially the entire base label front surface 108 or to be removed from the container 1000, in addition to being rotatable.

One skilled in the art will readily recognize that labels may be applied to containers using a variety of methods and that there may be a variety of single-label and multi-label systems other than those described above. Any such application methods or label systems may be used with the present disclosure. The above descriptions are exemplary and not to be construed as limiting in any way. Examples of other application methods and label systems may be disclosed in U.S. Pat. Nos. 5,884,421, 6,086,697, 6,237,269, 6,402,872, 6,631,578, 6,649,007, 7,087,298, and 7,172,668.

The label systems described above and illustrated in FIGS. 1 through 11 may comprise pressure sensitive, roll fed, or cut and stack labels, which generally require a flat surface on the container for mounting. For example, the container 500 in FIGS. 5A and 5B comprises recessed surface 512 in which the sides, as viewed in a front view as in FIGS. 5A and 5B, are straight and parallel to one another. Similarly, FIG. 10 illustrates a container 1000 with sides that are straight and parallel when viewed from the front of the container 1000. The base label 100 and top label 300 are placed on the "flat" surface. However, not all containers comprise a flat surface for mounting a label. Due to functional and aesthetic concerns, there may be no surfaces on the container with parallel sides on which to mount a label.

Figures 12A, 12B, 12C:
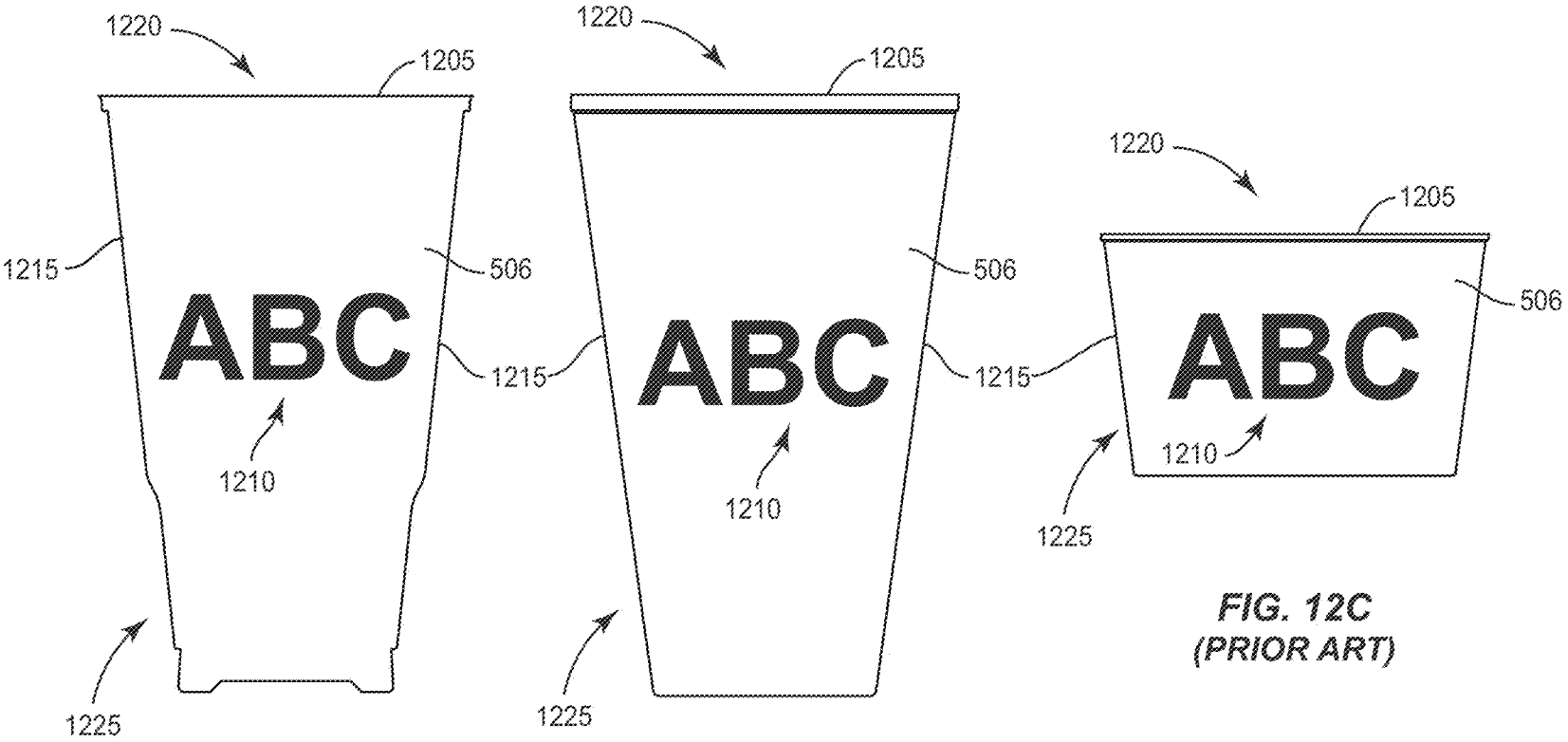
FIG. 12C (PRIOR ART)
FIG. 12B (PRIOR ART)
FIG. 12A (PRIOR ART)
FIGS. 12A through 12C are front views of prior art conically-shaped cups.

For example, FIGS. 12A through 12C illustrate various embodiments of a container (or drinking cup) 1205 with non-parallel sides 1215. The cup 1205 may also have any type of indicia 1210 printed on the external surface 506 of the cup 1205. Placing a label as described previously on such a cup 1205 may result in buckling and creasing of the label, and adhesion of the label to a surface of the cup 1205 may be unsatisfactory. Various embodiments of the label system described herein may provide solutions to these problems, as well as providing the manufacturer with expanded labeling space to present information to the consumer without resorting to separate inserts, leaflets, or other packaging.

FIGS. 12A through 12C also serve to illustrate a common problem with labeling systems for cups 1205 in that a shape of the cup 1205 is generally conical. Even when shrink labels (described below) are used on conically-shaped cups 1205, the labels have a tendency to ride up the sides 1215 of the cup 1205 during application or slip off as the consumer uses the cup 1205. The conical shape of the cup 1205, with a wide top portion 1220 and a lower portion 1225 narrower than the top portion 1220, lends itself to allowing the shrink label to ride up or slip off. The instability of the label position on the cup 1205 can pose problems for manufacturers that want to apply a full-body shrink label to the cup 1205. Further, in the case of a rotatable shrink label (described below), the shrink label should remain in place for proper functionality.

Figures 13A, 13B, 13C:
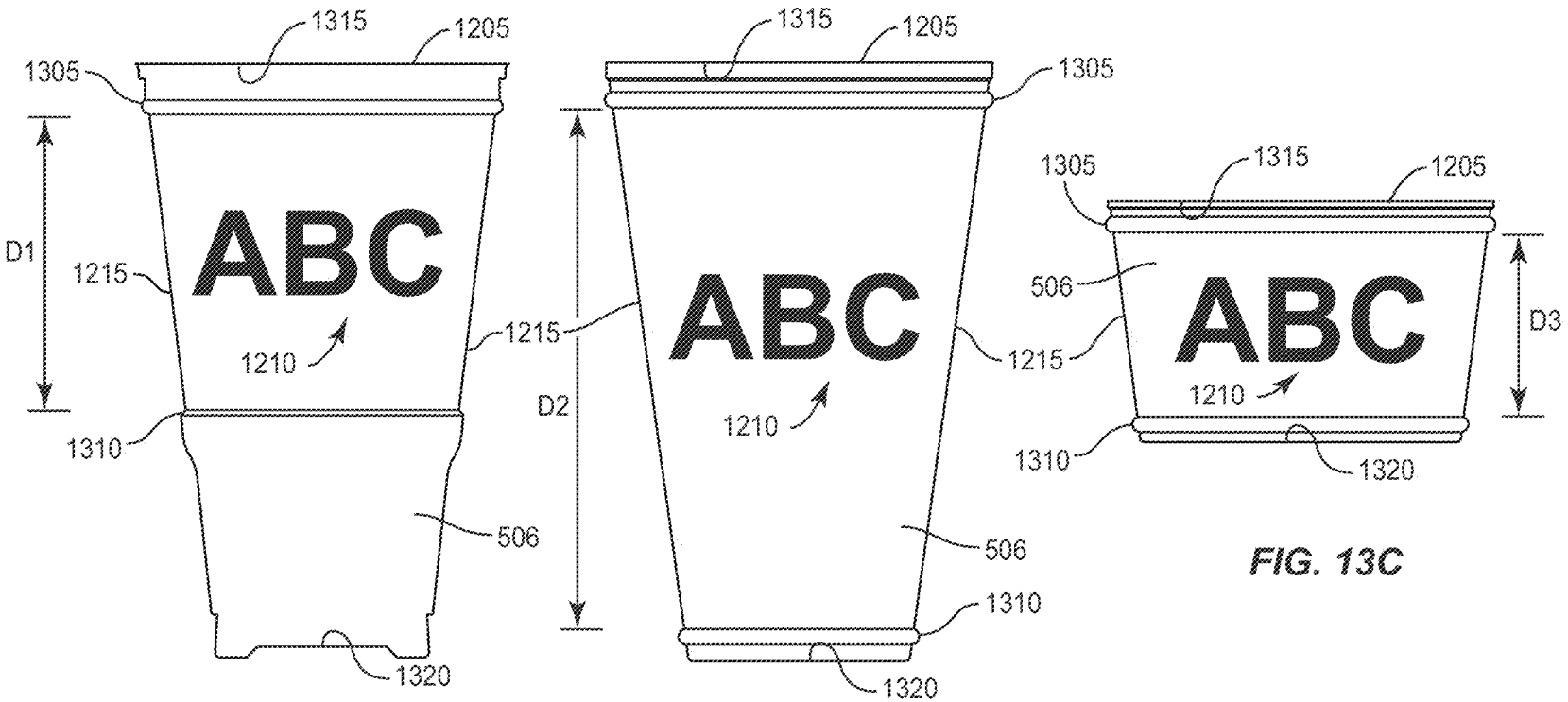
FIGS. 13A through 13C are front views of conically-shaped cups having first and second label locking features according to various embodiments.

FIGS. 13A through 13C illustrate various embodiments of conically-shaped cups 1205 adapted to lock a rotatable shrink label in place on the external surface 506 of the cup 1205. Various embodiments may comprise a first label locking feature 1305 in proximity to a top edge 1315 (or mouth) of the cup and a second label locking feature 1310 vertically spaced apart from the first label locking feature 1305 (that is, separated from one another along a vertical axis of the cup 1205). Each of the first and second label locking features 1305, 1310 may be molded circumferentially into the external surface 506 of the cup 1205. A distance that the first and second label locking features 1305, 1310 are spaced apart may vary depending on the shape of the cup 1205 and the requirements of the manufacturer. FIG. 13A illustrates various embodiments in which a distance D1 separating the first and second label locking features 1305, 1310 is considerable less than a height of the cup 1205. In this example, the shrink label would generally cover only that portion of the external surface 506 from the first label locking feature 1305 to the second label locking features 1310, and a lower section of the cup 1205 would remain uncovered. FIGS. 13B and 13C illustrate various embodiments in which the first and second label locking features 1305, 1310 are positioned in proximity to the top edge 1315 and a bottom edge 1320, respectively, of the cup 1205 such that the distance D2, D3 between the first and second label locking features 1305, 1310 comprises nearly the entire height of the cup 1205.

As illustrated in FIG. 13A, various embodiments of the first label locking feature 1305 may comprise a structure that protrudes outward from the external surface 506 of the cup 1205. The first label locking feature 1305 may allow for the shrink label to conform to the structure, thereby at least partially locking the shrink label in place on the external surface 506 of the cup 1205.

In various embodiments as also illustrated in FIG. 13A, the second label locking feature 1310 may comprise a ledge extending circumferentially around the cup 1205. The shrink label may be positioned on the external surface 506 such that an edge of the label abuts the ledge of the second label locking feature 1310, thereby preventing the shrink label from moving downward. Thus, the first label locking feature 1305 and the second label locking feature 1310 operate in conjunction with one another to effectively lock the shrink label into a desired position on the external surface 506 of the cup. In various embodiments, the first and second label locking features may be reversed, such that the ledge is positioned near the top edge 1315 of the cup 1205 and ledge is positioned closer to the bottom edge 1320 of the cup 1205.

FIGS. 13B and 13C illustrate various embodiments in which both the first and second label locking features 1305, 1310 comprise a structure that protrudes outward from the external surface 506 of the cup 1205. In these embodiments, the shrink label may overlap and conform to both the first and second label locking features 1305, 1310.

Figure 14C:
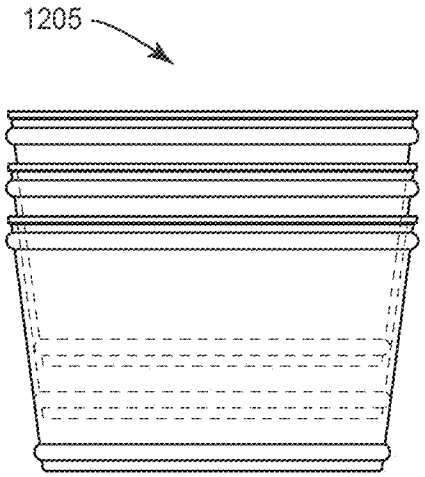
FIGS. 14A through 14C illustrate the nesting and stacking of the cups shown in FIGS. 13A through 13C according to various embodiments.
Figure 14B:
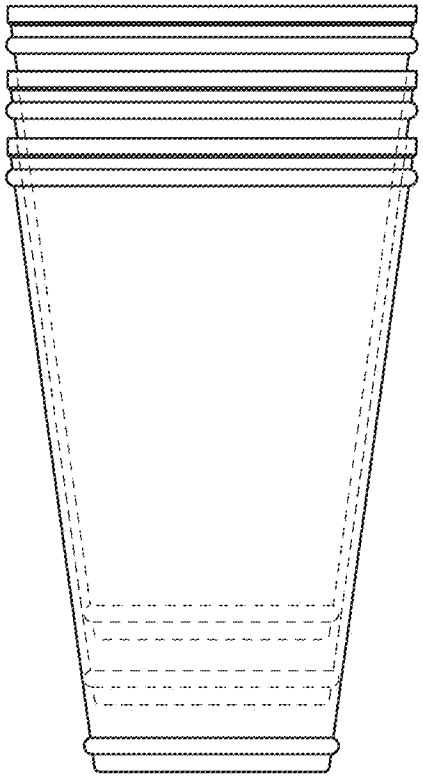
Figure 14A:
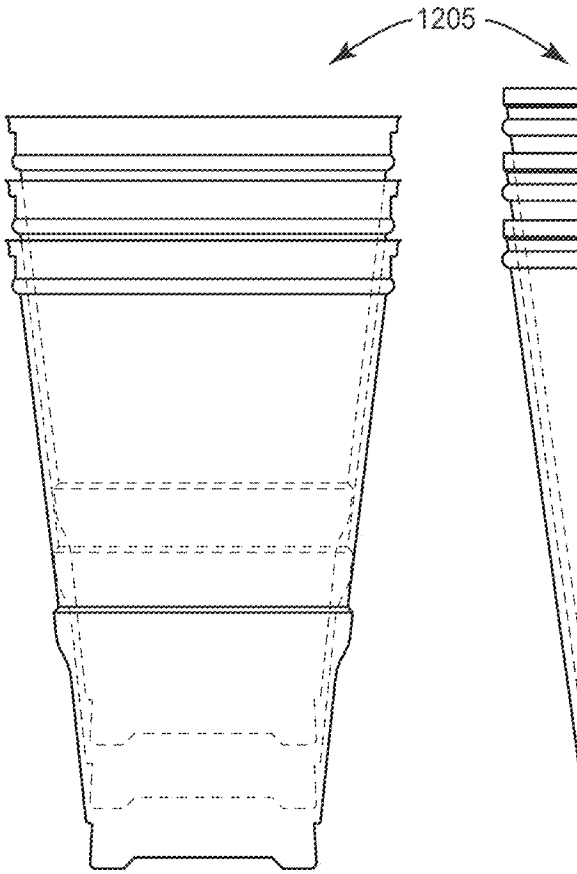

Conically-shaped cups 1205 as described herein are often packaged and shipped in nested stacks as illustrated in FIGS. 14A through 14C. The first and second label locking features 1305, 1310 may be sized and configured such that they do not interfere with the nesting. Additionally, the first and second label locking features 1305, 1310 may be sized and configured to allow each cup 1205 to be inserted nearly to the bottom of the cup 1205 in which it is nested as illustrated in FIGS. 14A through 14C to minimize a volume of a stack of nested cups 1205.

Figures 15A, 15B, 15C:
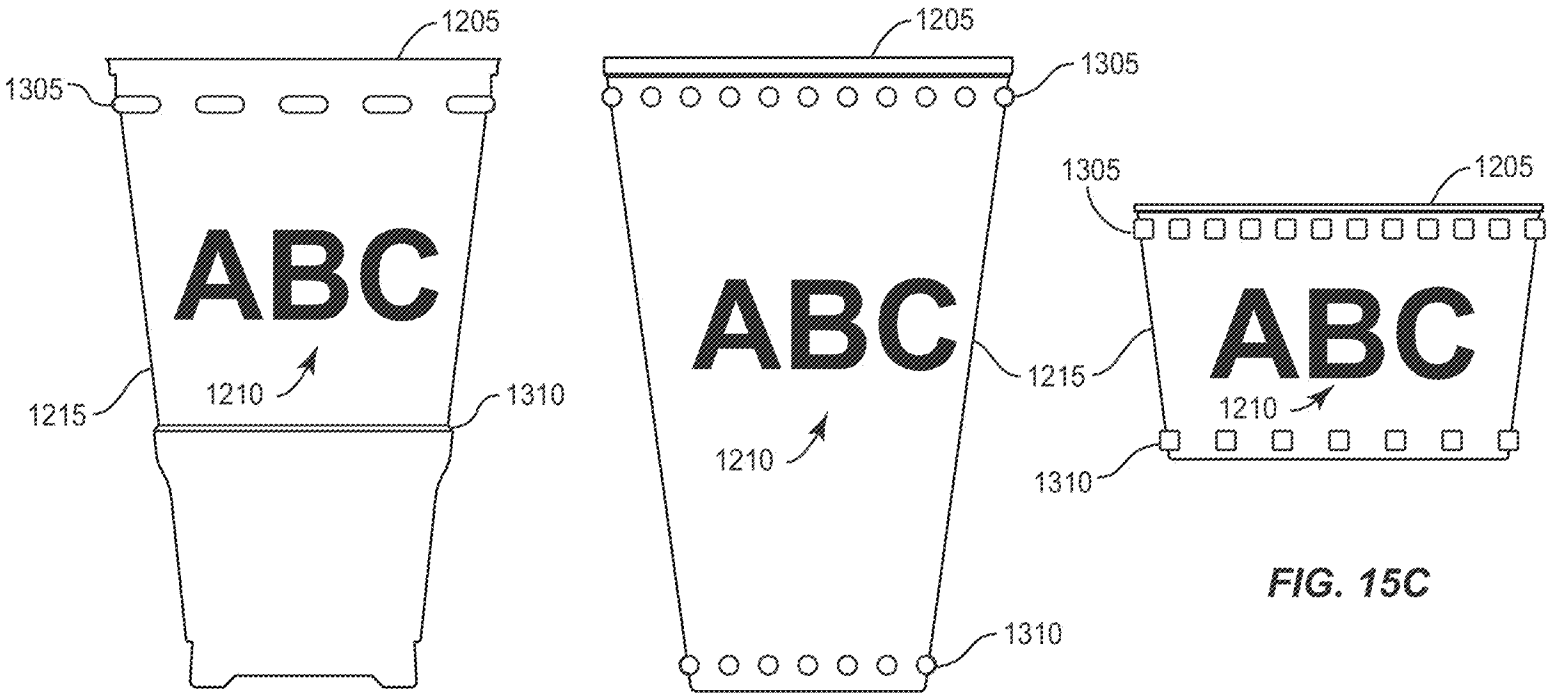
FIGS. 15A through 15C illustrate exemplary configurations for the first and second label locking features according to various embodiments.

In various embodiments, the first and second label locking features 1305, 1310 may be formed in any shape desired. As illustrated in FIGS. 13A through 13C, the first and second label locking features 1305, 1310 may be generally rounded and continuous around a circumference of the external surface 506. In other embodiments, the first or second label locking feature 1305, 1310 may be squared, or a combination of rounded and squared. As illustrated by the exemplary embodiments in FIGS. 15A through 15C, the first or second label locking feature 1305, 1310 may be discontinuous around the circumference of the external surface 506, and may take on any shape desired. When the first or second label locking feature 1305, 1310 is discontinuous, rotation of the shrink label may be restricted. In this case, the label locking features 1305, 1310 may serve to rotationally lock the shrink label, as well as locking the shrink label from vertical movement.

According to various embodiments, label systems may comprise a top shrink label 300 which comprises a material that dimensionally shrinks when exposed to an energy source. Such a material, commonly known as "shrink wrap," may comprise a thermoplastic packaging film manufactured from resins such as polyolefins or polyvinyl chlorides. The shrink wrap may also comprise, individually or in mixtures, ionomers, polyesters, polystyrenes, polyvinylidene chlorides, polypropylene terephthalate, low shrink force polypropylene terephthalate, oriented polystyrene, and polylactic acid among others. The shrink wrap material may comprise a monolayer or a multilayer construction. The energy source may be heat, such as a hot air or hot water stream, radiant heat, ultraviolet light, and may include irradiation when cross-linking of the resin is desired, or any energy source known in the art either singly or in combination. In various embodiments, the shrink wrap material used for the top shrink label 300 may comprise a low force shrink film such that it shrinks sufficiently to conform to the cup 1205 and the first and second label locking features 1305, 1310, but not so forcefully that the top shrink label 300 deforms or crushes the cup 1205.

Figures 16A, 16B, 16C:
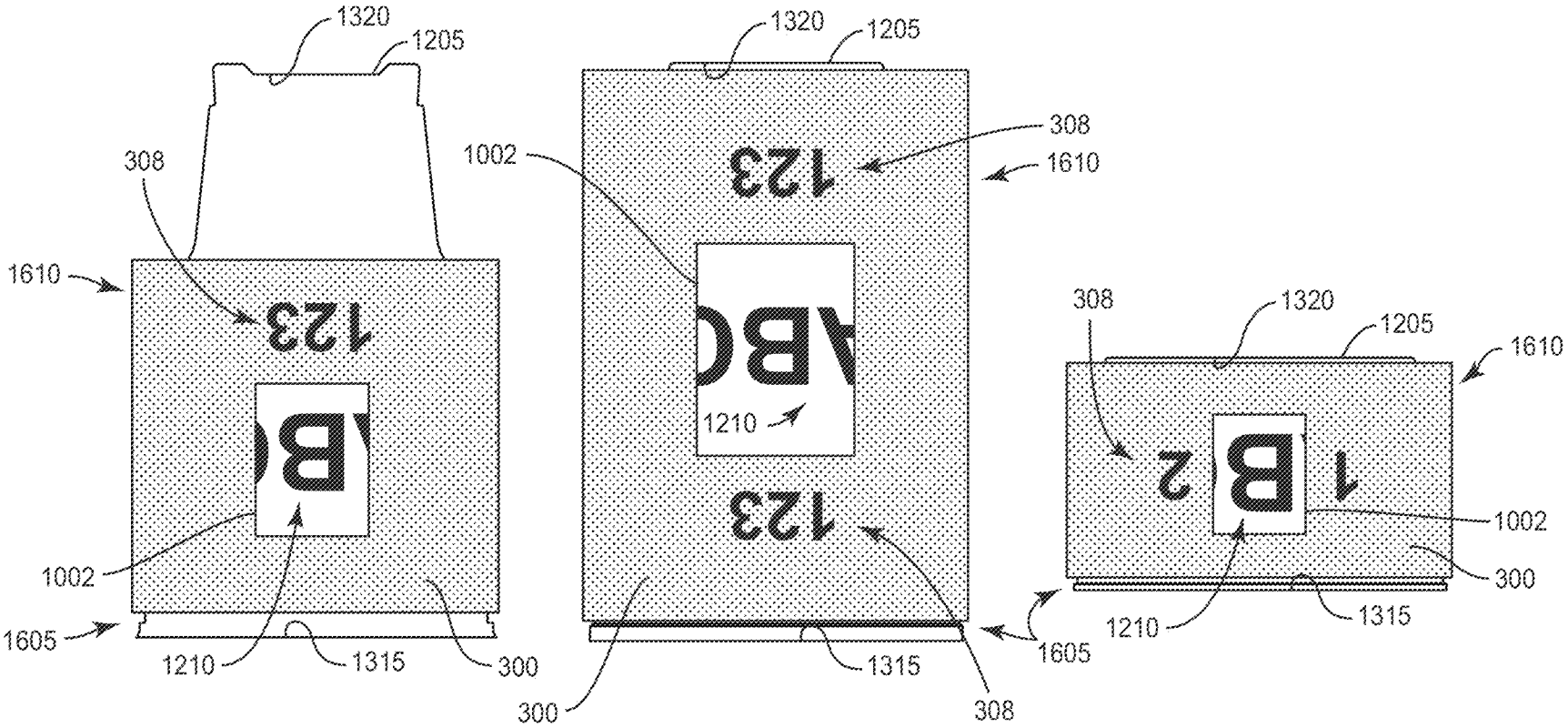
FIGS. 16A through 16C illustrate the cups of FIGS. 13A through 13C inverted on an assembly line with a top shrink label positioned around each cup prior to applying heat to the top shrink label according to various embodiments.

FIGS. 16A through 16C illustrate assembly of the top shrink label 300 onto the cup 1205. The top shrink label 300 may comprise indicia 308 printed thereon. First, the cup 1205 is placed upside down. The top shrink label 300 may be rolled into a cylindrical shape by joining or overlapping leading edge 102 and trailing edge 104. Alternatively, the top shrink label 300 may be provided as a continuously formed cylinder which is cut to the desired length prior to application on the container 1205. In further embodiments, the top shrink label 300 may be supplied in roll form which is cut into individual sheets and applied like conventional roll-fed labels (not shown).

Figure 17C:
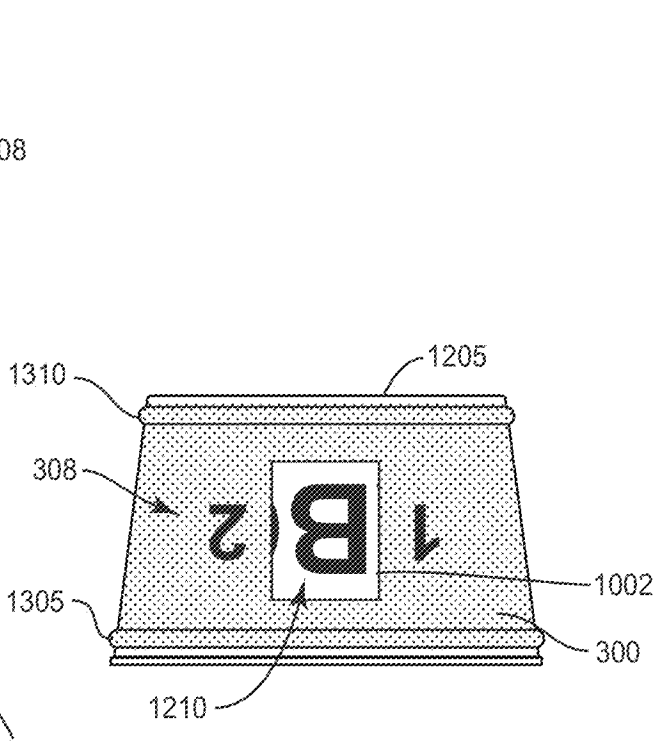
FIGS. 17A through 17C illustrate the cups and top shrink labels of FIGS. 16A through 16B after heat has been applied to the shrink labels and the shrink labels have conformed to the cup according to various embodiments.
Figure 17B:
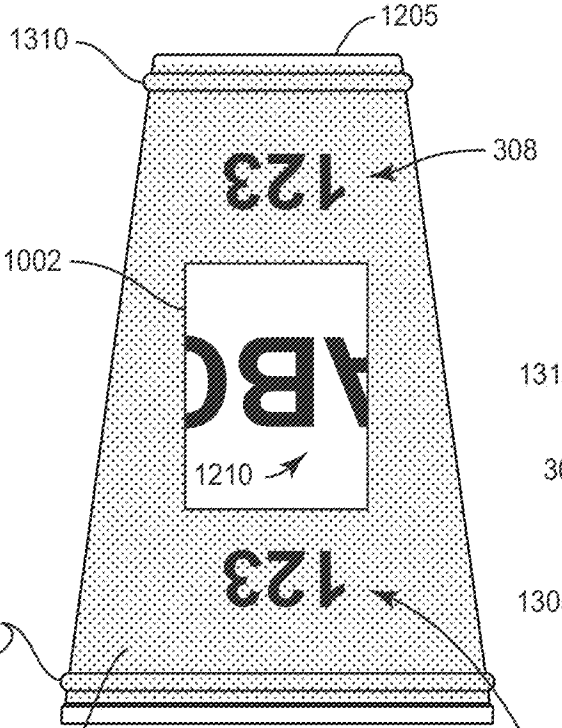
Figure 17A:
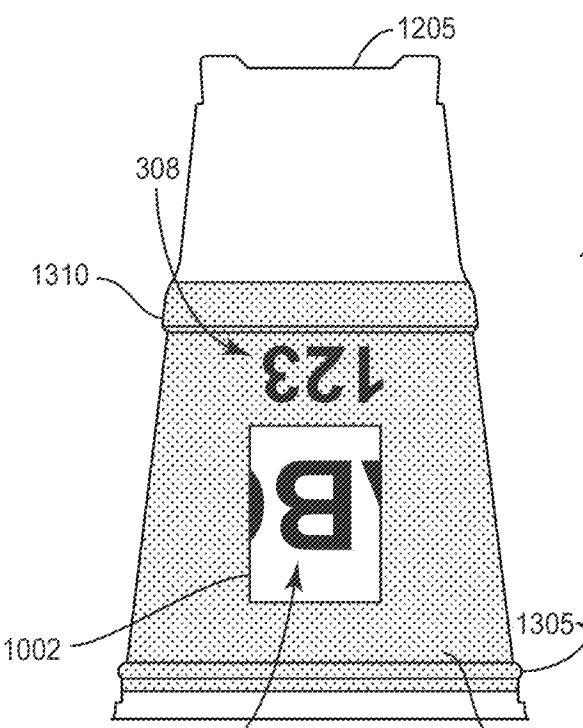

The non-shrunk top shrink label 300 may then be placed around the container 1205 as illustrated in FIGS. 16A through 16C. The top shrink label 300 may then be exposed to an energy source which causes the top shrink label 300 to shrink and smoothly conform to the conically-shaped sides 1215 of the container 1205 as illustrated in FIGS. 17A through 17C. The first label locking feature 1305 positioned near the top edge 1315 of the cup 1205 may act as an initial gripping point for the top shrink label 300 as the top shrink label 300 is being shrunk to the cup 1205. As the cup 1205 and the top shrink label 300 pass through a heat tunnel or other heating mechanism, the portion of the top shrink label 300 near the first label locking feature 1305 may be heated first so that portion of the top shrink label 300 conforms to the first label locking feature 1305, thereby properly positioning the top shrink label 300 on the external surface 506 of the cup 1205. The remainder of the top shrink label 300 may then be heated so that it conforms to the cup 1205 and the second label locking feature 1310.

Various embodiments of the top shrink label 300 may comprise one or more windows 1002. Once the top shrink label 300 is applied to the cup 1205, a portion of the printed cup indicia 1210 on the external surface 506 of the cup 1205 may be visible through the window 1002 as illustrated in FIGS. 17A through 17C. In various embodiments, the window 1002 may be formed by removing a portion of the top shrink label 300, creating a hole through which the cup indicia 1210 is visible. In other embodiments, the top shrink label 300 may comprise a transparent material, and opaque areas of printing as well as alphanumeric characters, may define the windows 1002. Thus, areas of the top shrink label 300 with no opaque areas of printing may function as a window 1002 when the top shrink label 300 is made from a transparent material.

Figure 18:
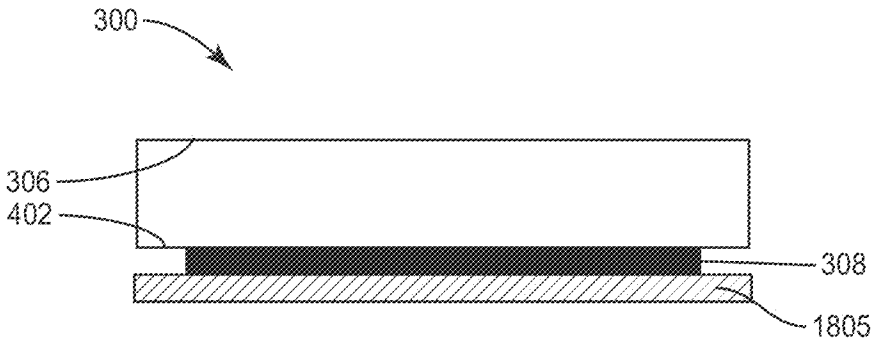
FIG. 18 is a cross-sectional view of a top label according to various embodiments.

Because the top shrink label 300 comprises a shrinkable material, after shrinking there may be intimate contact between the top shrink label back surface 402 and the external surface 506 of the cup 1205. This contact may create a strong frictional force that impedes rotation of the top shrink label 300. Additionally, the frictional contact may abrade any printed information 308 on the top shrink label 300 or printed indicia 1210 on the external surface 506 of the cup 1205. According to various embodiments as illustrated in FIG. 18, the top shrink label 300 may comprise a transparent material. The printed information 308 of the top shrink label 300 may be printed on the top shrink label back surface 402 such that the printed information 308 is visible through the transparent material. Placing the printed information 308 on the top shrink label back surface 402 protects the printed information 308 from abrasion due to handling. In addition, a friction reducing coating 1805 may be placed over the printed information 308 and the top shrink label back surface 402 to protect the printed information 308 from abrasion when the top shrink label 300 is rotated.

In order to allow the top shrink label 300 to rotate about the cup 1205, the tension of the shrink wrap material after shrinking may be controlled so that the top shrink label 300 conforms to the shape of the cup 1205 but not so tightly that it cannot rotate. During the heating process, the tension may be controlled by varying the temperature to which the top shrink label 300 is exposed such that the top shrink label 300 shrinks but does not adhere to the cup 1205.

The top shrink label 300 may comprise a dual ply (or multi-ply) construction in which a ply in contact with the external surface 506 of the cup 1205 is a material selected for low sliding friction characteristics. The low sliding friction characteristics may enhance the ease of rotating the top shrink label 300 about the cup 1205. In various embodiments, the top shrink label 300 ply in contact with the external surface 506 of the cup 1205 may be coated with a substance to impart the low sliding friction characteristics.

Figures 19A, 19B, 19C:
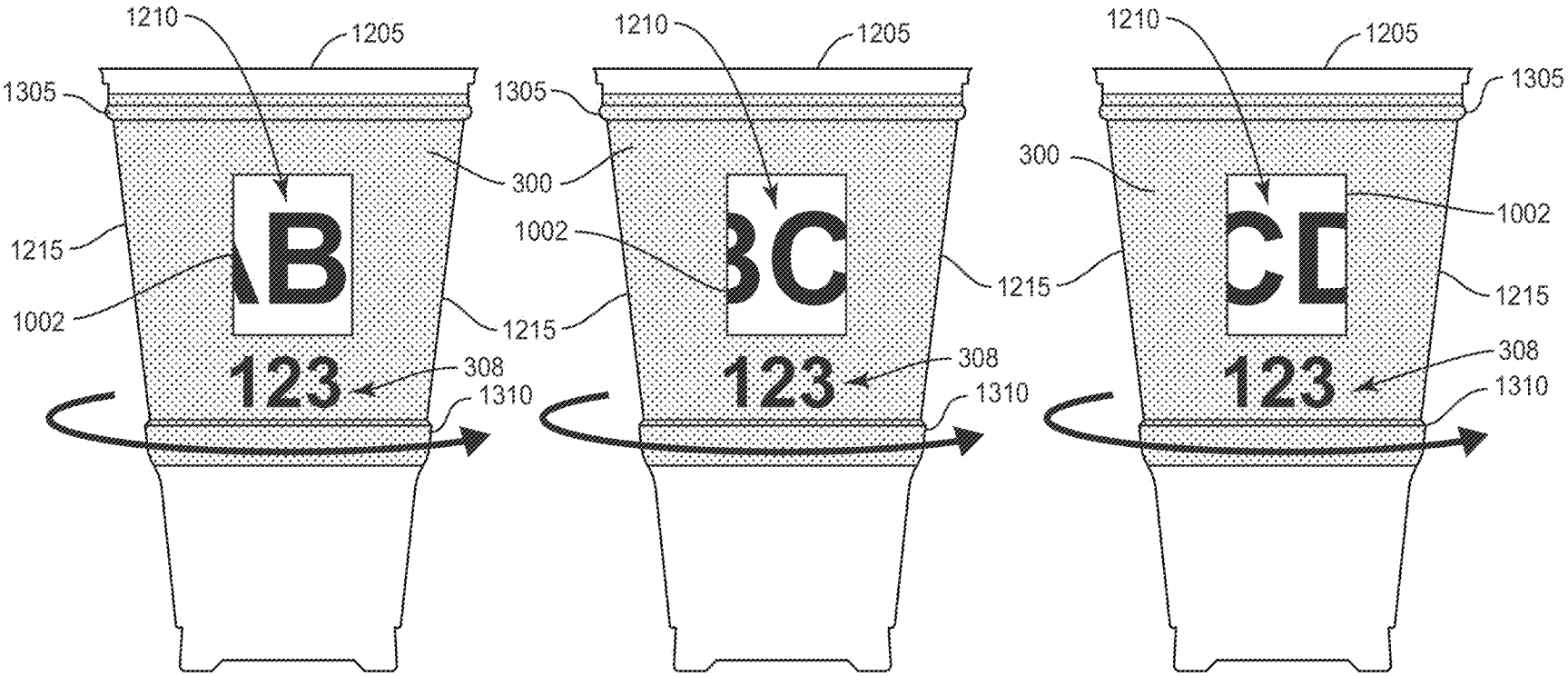
FIGS. 19A through 19C illustrate the rotation of the top shrink label about the cup according to various embodiments.

FIG. 19A through 19C illustrate the operation of the rotatable top shrink label 300 according to various embodiments. As the top shrink label 300 is rotated about the cup 1205, various portions of the cup indicia 1210 may be visible through the window 1002. The rotatability of the top shrink label 300 allows indicia 1210 to be viewed around the entire circumference of the cup 1205. The first and second label locking features 1305, 1310 maintain proper alignment of the window 1002 to the cup indicia 1210, as well as vertically locking the top shrink label 300 in place on the cup 1205.

Figure 20:
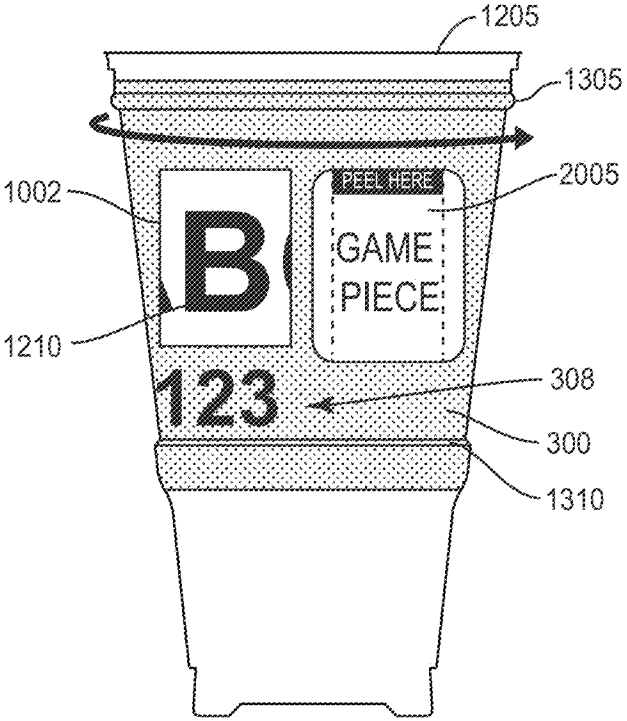
FIG. 20 is a front view of a container with a game piece coupled to the top shrink label according to various embodiments.
Figure 21:
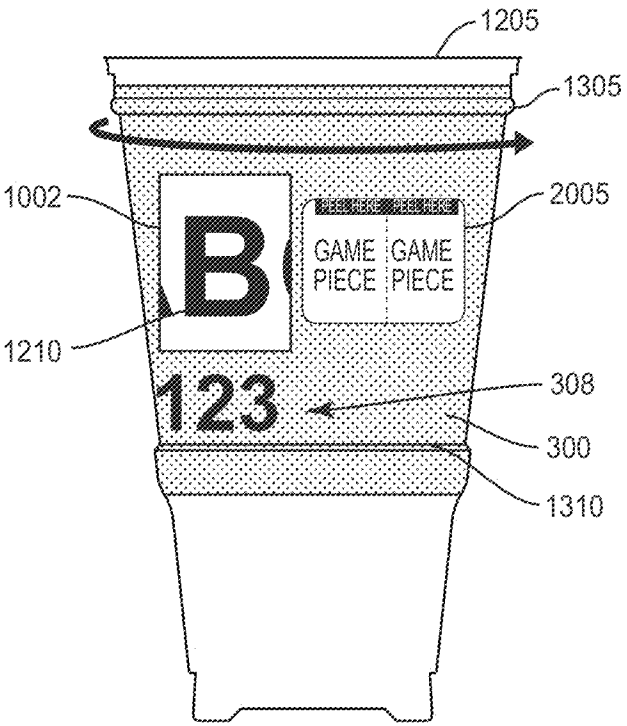
FIG. 21 is a front view of a container with multiple game pieces coupled to the top shrink label according to various embodiments.

FIG. 20 illustrates examples of an interactive label system for use with a gaming or promotional embodiment. The label system may comprise three promotional elements. The first promotional element may comprise the indicia or promotional material 1210 printed or otherwise coupled (such as by a sticker or base label 100 as described previously) on the external surface 506 of the cup 1205. The second promotional element may comprise the top shrink label 300 and the printed information 308 or promotional material thereon. The third promotional element may comprise a game piece 2005 or other indicia or promotional material printed or otherwise coupled to the top shrink label 300. As illustrated in FIG. 21, the third promotional element may comprise multiple game pieces 2005.

The first, second, and third promotional elements may be linked to complete a promotional event. In various embodiments, a promotional event may comprise coupons, crossword and other puzzle games, word search games, spelling games, number matching games, probability games, controlled probability games, continuity games, instant win games, sweepstakes, collector promotions, contest invitations, rebates, and the like. The first, second, and third promotional elements may, for example, each contain a portion of a code that when combined complete the promotional event. If the code matches a master code, then the first, second, and third promotional elements may constitute a winner of the promotional event.

Figures 22A, 22B, 22C:
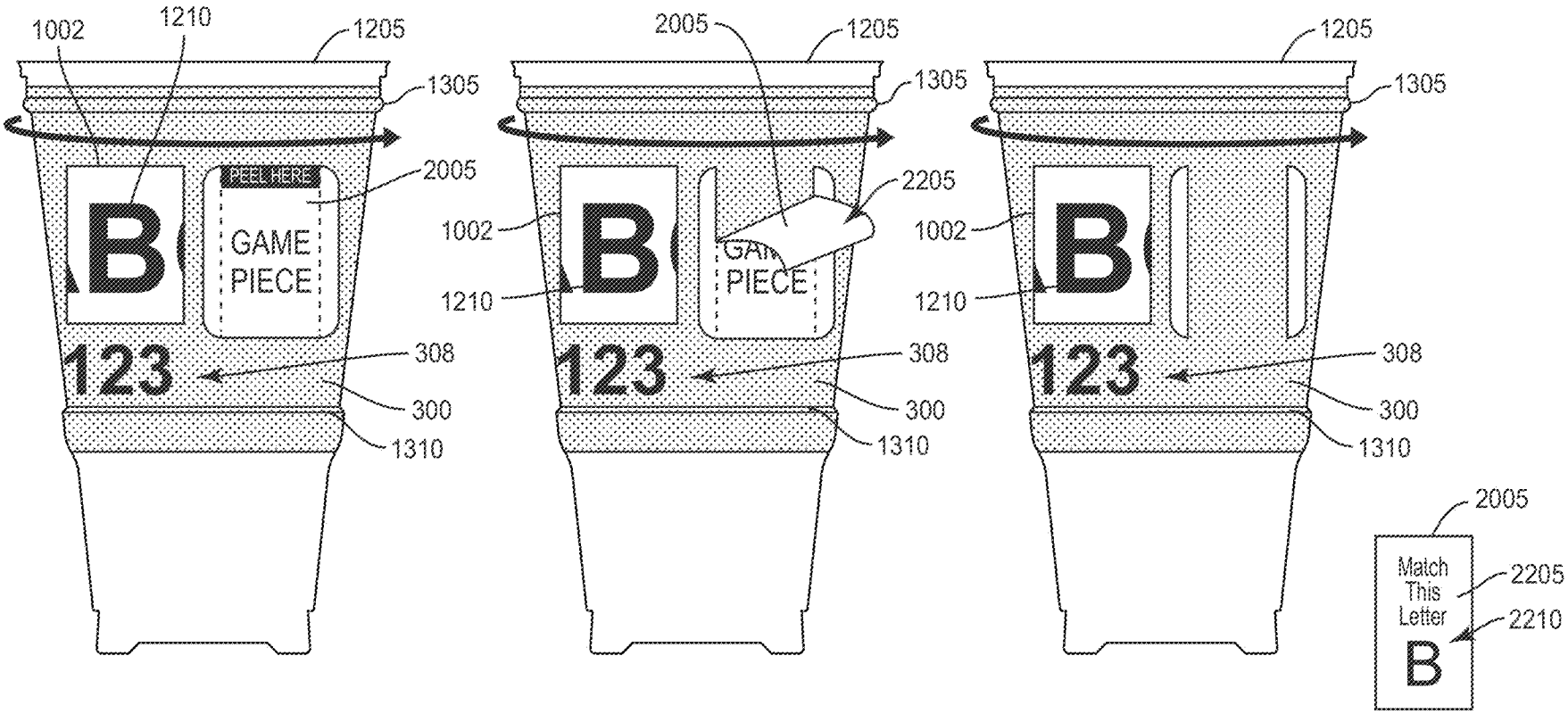
FIGS. 22A through 22C illustrate the removal of the game piece from the top shrink label according to various embodiments.

The first, second, and third promotional elements may comprise any combination of alphanumeric characters, pictures, words, codes, bar codes, QR codes, and the like. An exemplary embodiment is illustrated in FIG. 22A through 22C. In this example, the first promotional element comprises the indicia 1210 printed on the external surface 506 of the cup 1205. The second promotional element comprises the printed information 308 (or any other promotional material) on the top shrink label 300. The third promotional element may be printed on or contained in the game piece 2005. As shown in FIG. 22B, all or a portion of the game piece 2005 may be removable from the top shrink label 300, revealing a hidden surface 2205 of the game piece 2005. In FIG. 22C, the game piece 2005 is removed from the top shrink label 300, and indicia 2210 may be printed on the hidden surface 2205. The indicia 2210 of the hidden surface 2205 may comprise the third promotional element.

In the example of FIGS. 22A through 22C, the promotional event begins when the third promotional element is revealed and the user tries to match the code of the third promotional element with one of the cup indicia 1210. The user may rotate the top shrink label 300, thereby exposing all of the portions of the cup indicia 1210 in the window 1002. The information 308 on the top shrink label may indicate a prize that is won if, for example, there is a match between the indicia 2210 on the game piece 2005 and the cup indicia 1210. Once the user determines whether there is a match, the promotional event may be concluded.

Figures 23A, 23B, 23C:
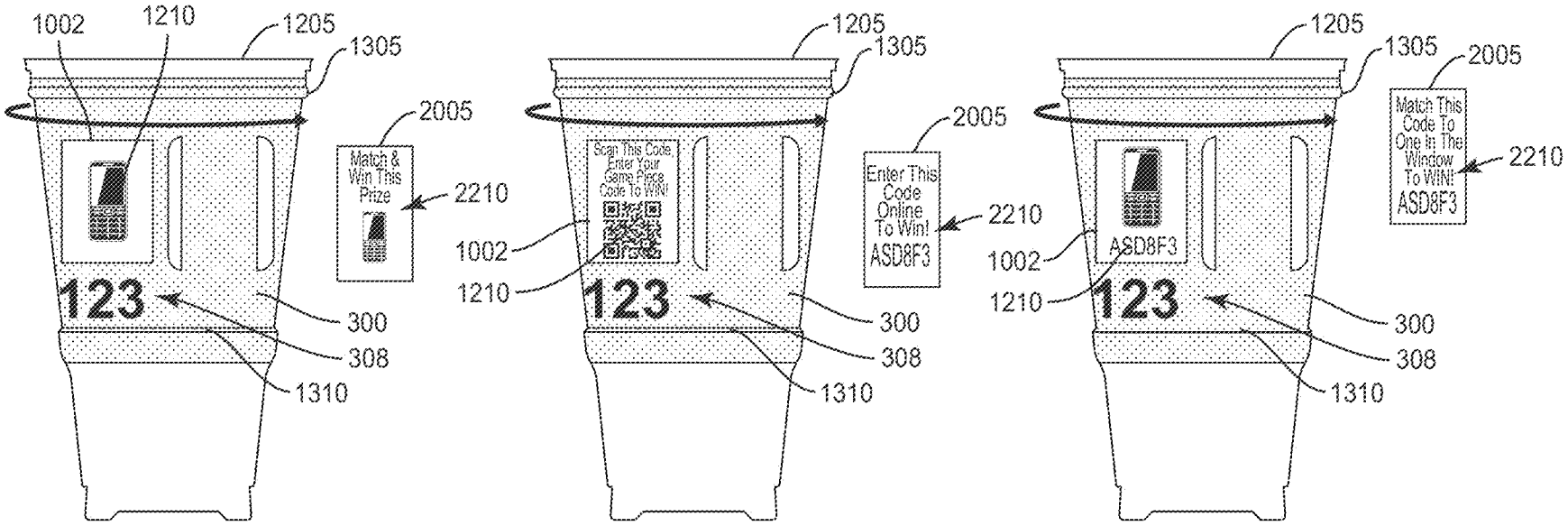
FIGS. 23A through 23C illustrate the interactive first, second, and third promotional elements according to various embodiments.

FIGS. 23A through 23C illustrate various embodiments of the promotional event. In FIG. 23A, the indicia 2210 on the game piece 2005 comprises a picture of a prize. Matching the indicia 2210 picture with an identical picture of the cup indicia 1210, and/or the printed information 308 on the top shrink label 300, may complete the promotional event. In FIG. 23B, the cup indicia 1210 may comprise a machine readable code (such as the QR code shown) that when scanned by an electronic device causes the electronic device to execute a function. An exemplary function may be to access a web site through a connection to the Internet. The function may cause instructions to be displayed on the electronic device to enter one or more of the codes or other indicia of the cup indicia 1210, the top shrink label 300 printed information 308, and the game piece indicia 2210. Once the function determines whether the entered code(s) are a winning code, the promotional event may be completed. Yet another exemplary promotional event is illustrated by FIG. 23C. In this example, the indicia 2210 of the game piece 2005 may comprise a code. This code may be compared to similar codes of the cup indicia 1210 or top shrink label 300 printed information 308. If a match is found, then the prize associated with the code on the cup indicia 1210 may be won, completing the promotional event.

Figure 24B:
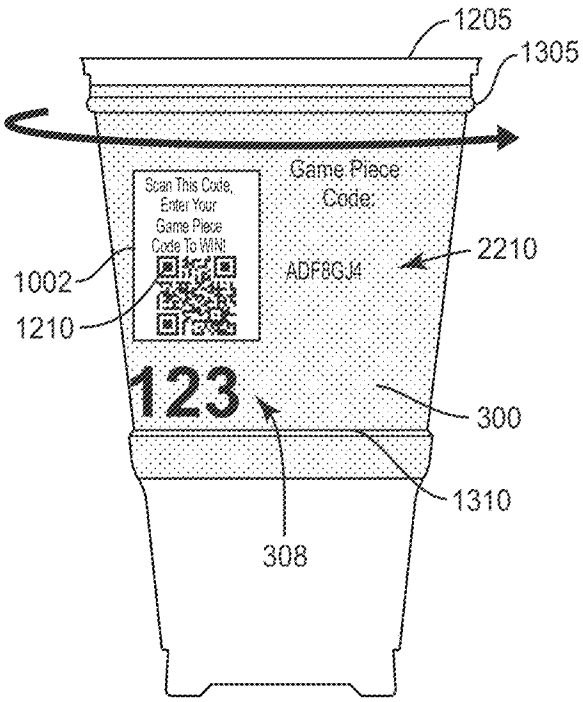
FIGS. 24A and 24B illustrate the interactive first, second, and third promotional elements according to various embodiments.
Figure 24A:
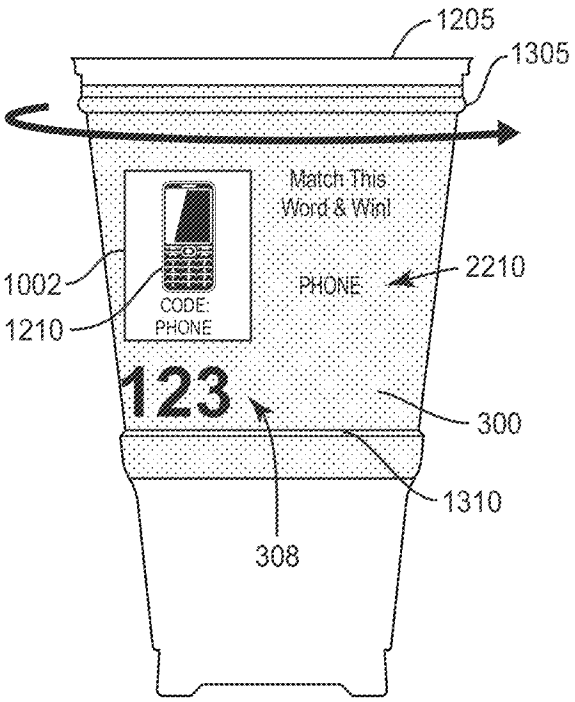

FIGS. 24A and 24B illustrate various embodiments in which the game piece indicia 2210 is printed directly on the top shrink label 300, rather than on a removable game piece 2005. In various embodiments, the removable game piece 2005 may cover the game piece indicia 2210 printed on the top shrink label 300, and the user would remove the game piece 2005 to reveal the game piece indicia 2210 on the top shrink label 300.

Figure 25B:
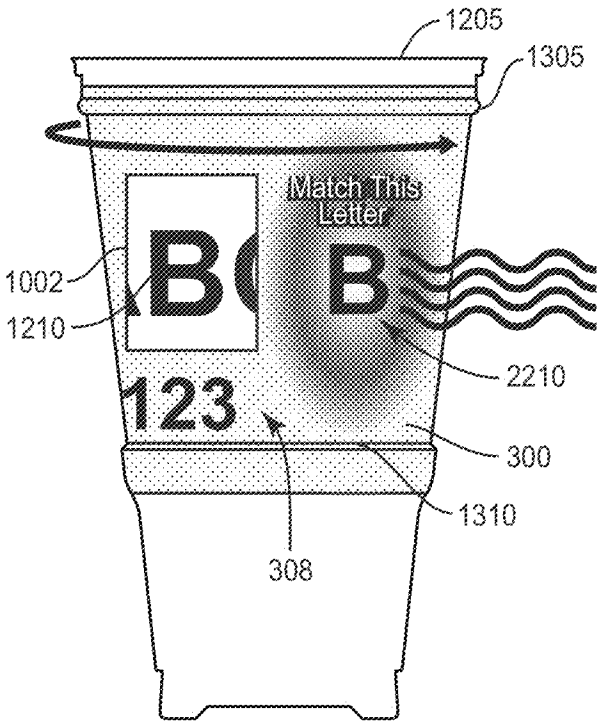
FIGS. 25A and 25B illustrate the use of thermochromatic ink according to various embodiments.
Figure 25A:
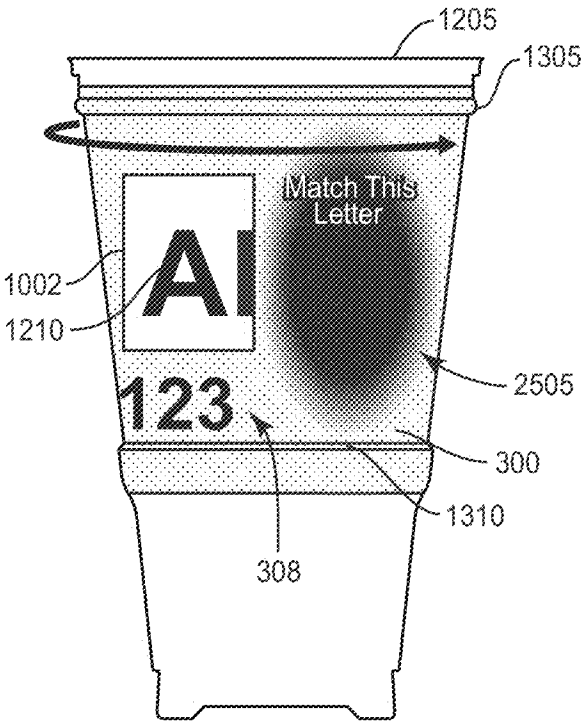
Figure 26B:
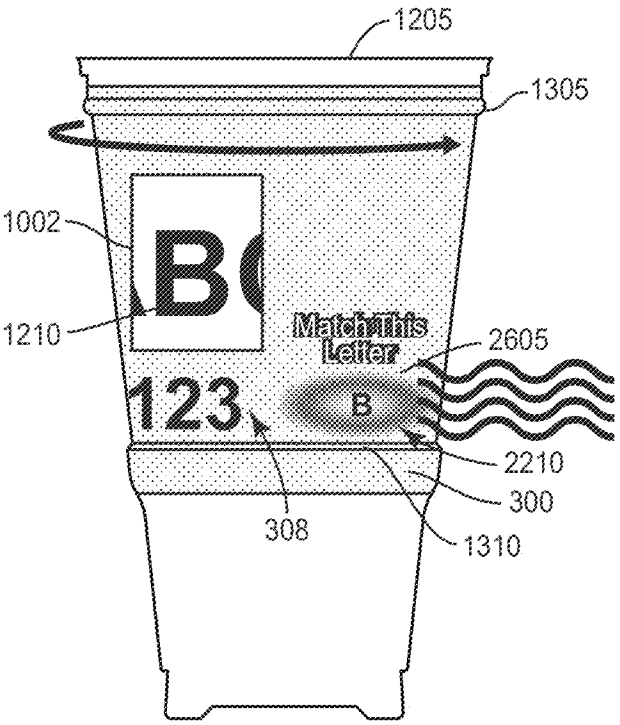
FIGS. 26A and 26B illustrate the use of thermochromatic ink according to various embodiments.
Figure 26A:
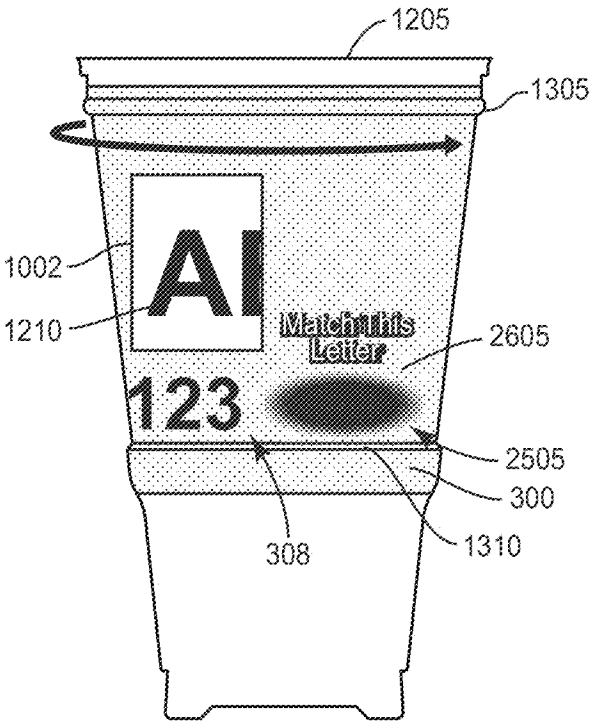
Figure 27B:
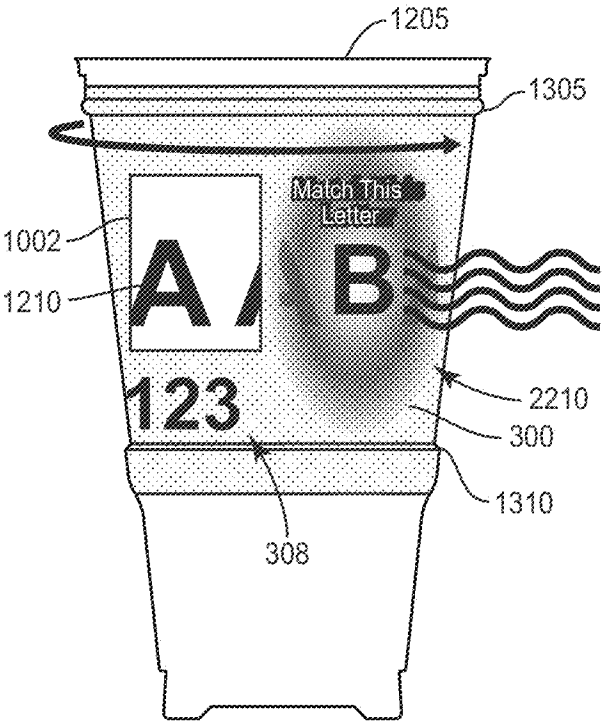
FIGS. 27A and 27B illustrate the use of thermochromatic ink according to various embodiments.
Figure 27A:
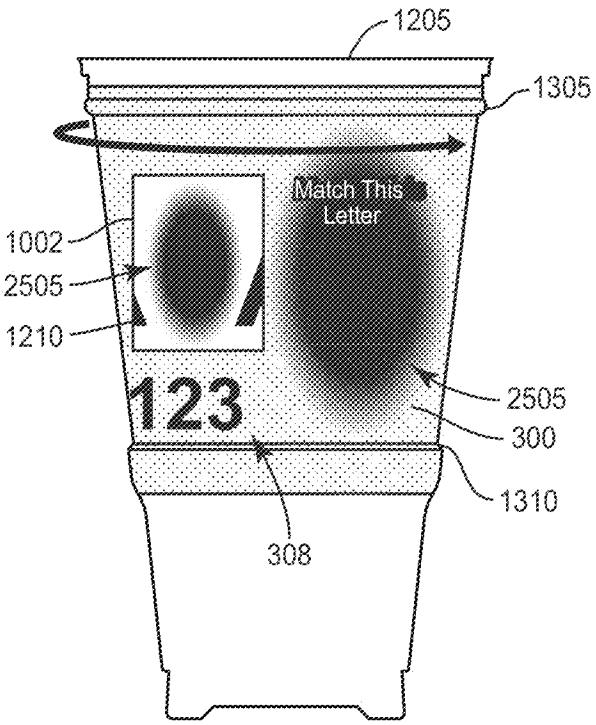

FIGS. 25A and 25B illustrate various embodiments in which the game piece indicia 2210 is printed on the top shrink label 300, then overprinted with a thermochromatic or color changing ink 2505 that is opaque at room temperature. Depending on the type of thermochromatic ink 2505 used, the user may apply heat to the thermochromatic ink 2505 to reveal the game piece code 2210 underneath. Alternatively, the thermochromatic ink 2505 may be altered by cold, and after the cup 1205 is filled with a cold drink the thermochromatic ink 2505 reveals the game piece code 2210. As another example as shown in FIGS. 26A and 26B, the top shrink label 300 may comprise a transparent section 2605 overprinted with thermochromatic ink 2505. When the thermochromatic ink 2505 is exposed to heat or cold, the transparent section 2605 is revealed and the game piece indicia 2210 printed on the cup 1205 may be visible through the transparent section 2605. Finally, as illustrated in FIGS. 27A and 27B, the thermochromatic ink 2505 may be used in conjunction with any of the first, second, and third promotional elements.

Figure 28B:
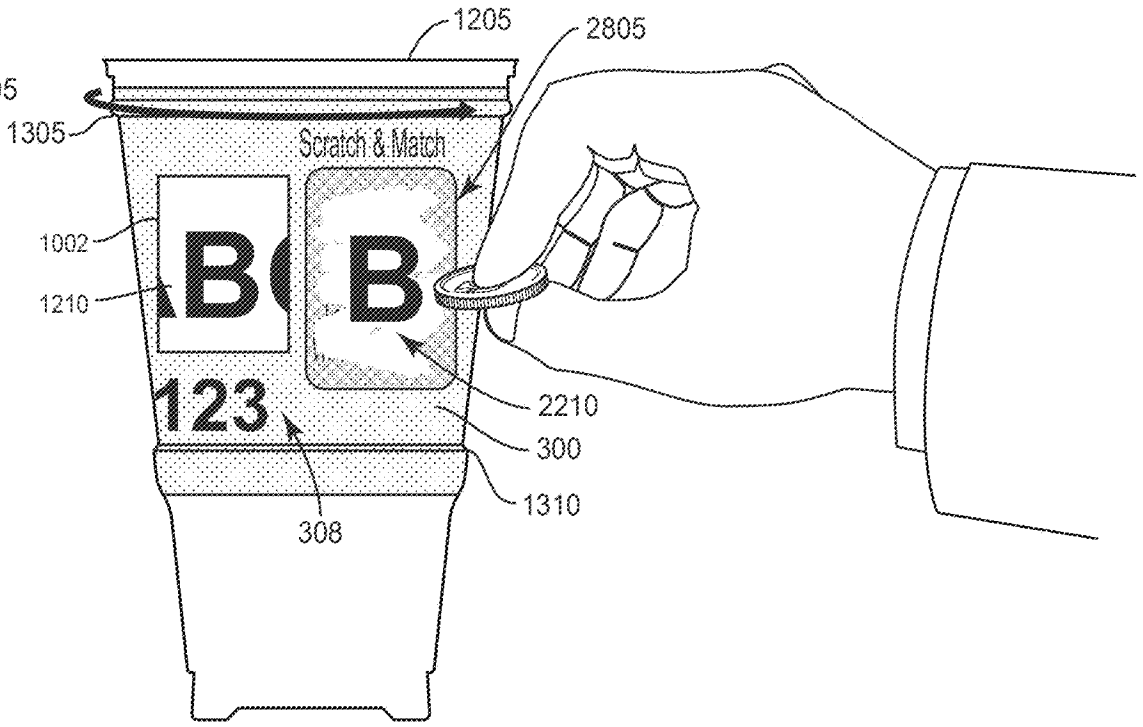
FIGS. 28A and 28B illustrate the use of scratch off ink according to various embodiments.
Figure 28A:
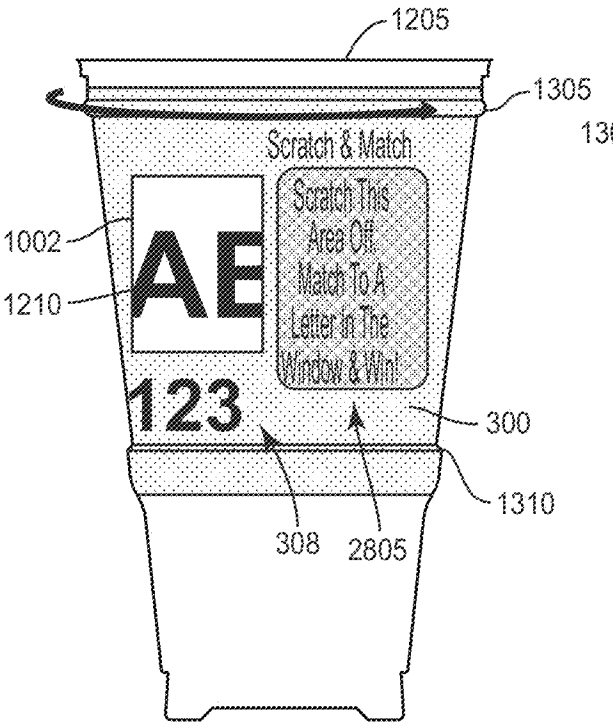
Figures 29A, 29B, 29C:
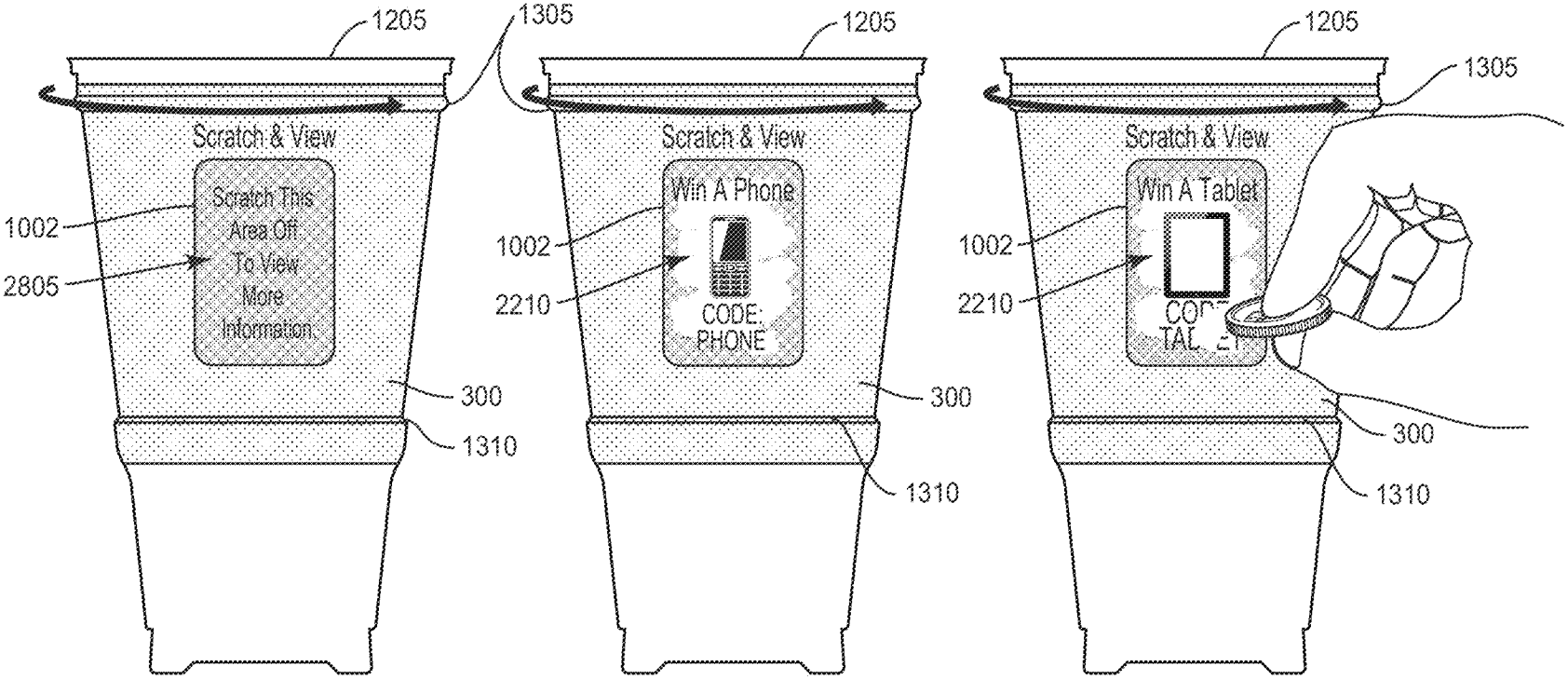
FIGS. 29A and 29B illustrate the use of scratch off ink according to various embodiments.

FIGS. 28A and 28B illustrate the game piece indicia 2210 printed on the top shrink label 300 and overprinted with a scratch off ink 2805 according to various embodiments. In this example, the user may use a coin or other implement to remove the scratch off ink 2805 and reveal the game piece indicia 2210. In FIGS. 29A through 29C, embodiments are illustrated in which the window 1002 is overprinted with the scratch off ink 2805, and removing the scratch off ink 2805 may reveal the game piece indicia 2210 directly on the external surface 506 of the cup 1205.

Figure 30C:
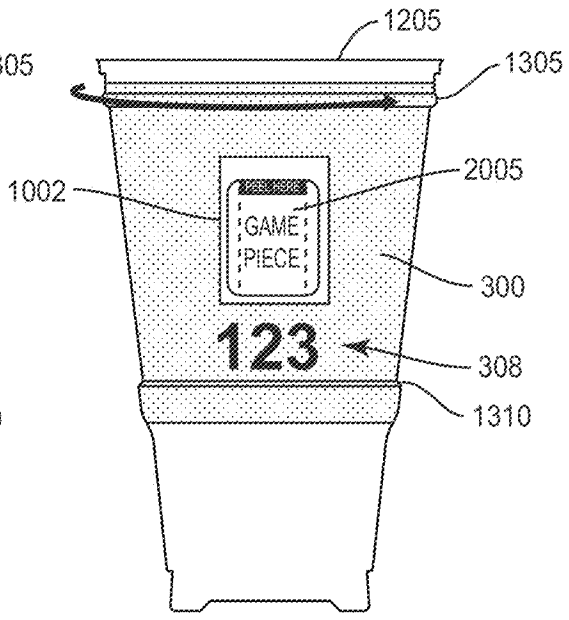
FIGS. 30A through 30C illustrate the placement of the game piece on the cup according to various embodiments.
Figure 30B:
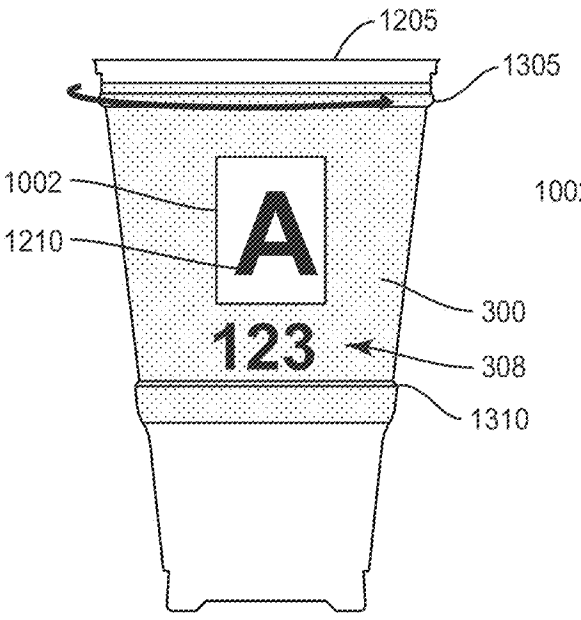
Figure 30A:
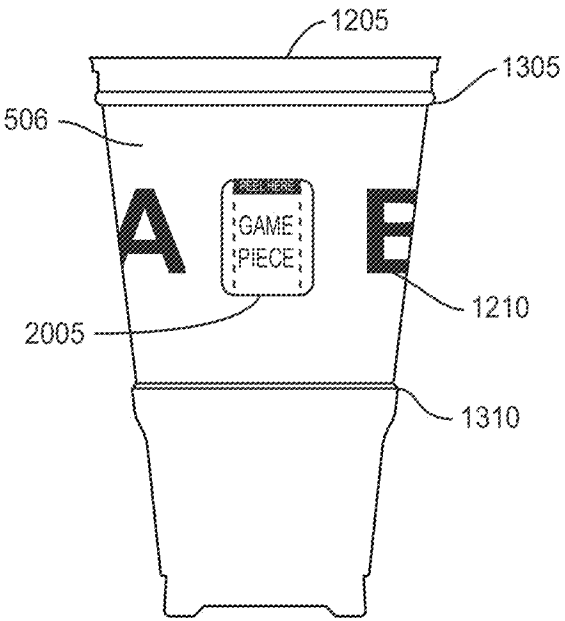

In various embodiments, the game piece 2005 may be coupled to the external surface 506 of the cup 1205 as illustrated in FIGS. 30A through 30C, instead of coupled to the top shrink label 300. In FIG. 30A, the game piece 2005 is coupled to the external surface 506 aligned with the cup indicia 1210 so that the game piece 2005 will be visible through the window 1002 in the top shrink label 300. The top shrink label 300 is then applied, and then rotated until the game piece 2005 is visible through the window 1002. If the window 1002 is an opening cut into the top shrink label 300, then the user can align the window 1002 with the game piece 2005 and remove the game piece 2005 directly. If instead, the window 1002 is a transparent section of the top shrink label 300, then the top shrink label 300 may have to be removed to obtain access to the game piece 2005. In this way, the top shrink label 300 serves as a security device or tamper evident feature to prevent unauthorized access to the game piece 2005. Alternatively, the transparent section of the top shrink label 300 may be removable (such as by tearing perforations along one or more edges of the transparent section) to gain access to the game piece 2005 without removing the entire top shrink label 300.

Figure 31B:
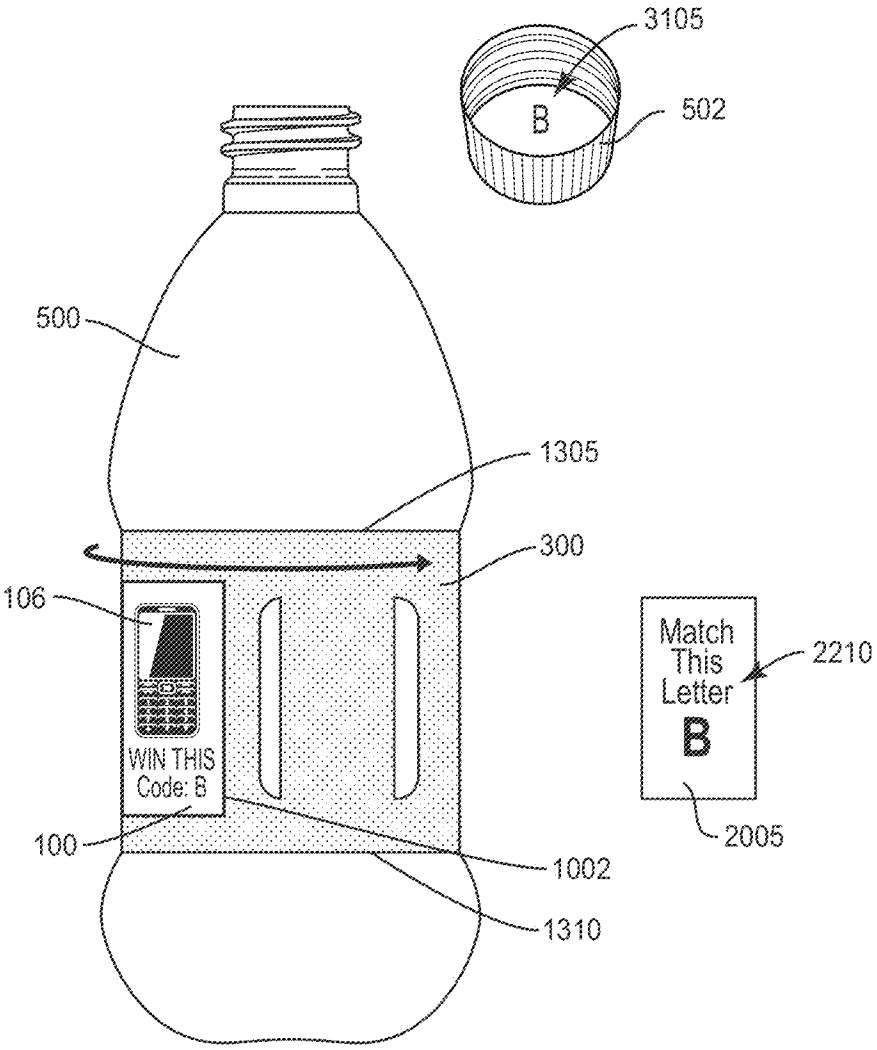
FIGS. 31A and 31B illustrate the container and shrink label system where the container is a bottle with a cap according to various embodiments.
Figure 31A:
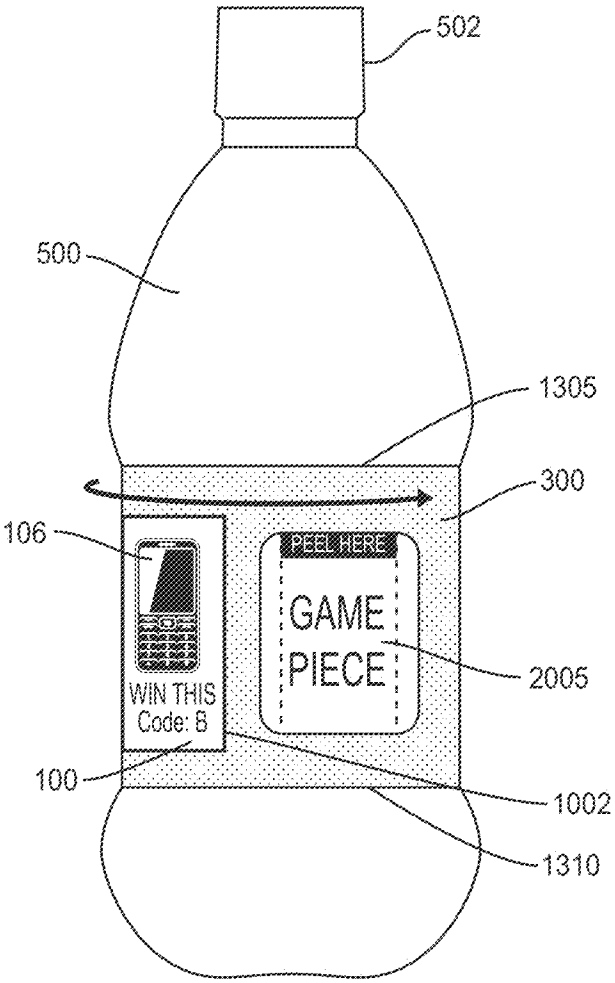

Although the previous discussion has been focused on a cup 1205 as the container, the interactive label system as described may be applied to any type of container. For example, FIGS. 31A and 31B illustrates the bottle 500 as the container. The indicia 106 on the base label 100 may comprise the first promotional element. The second promotional element may comprise indicia 3205 printed on the inside of the cap 502. The game piece 2005, as described previously and coupled to the top label 300, may comprise the third promotional element.

Figure 32:
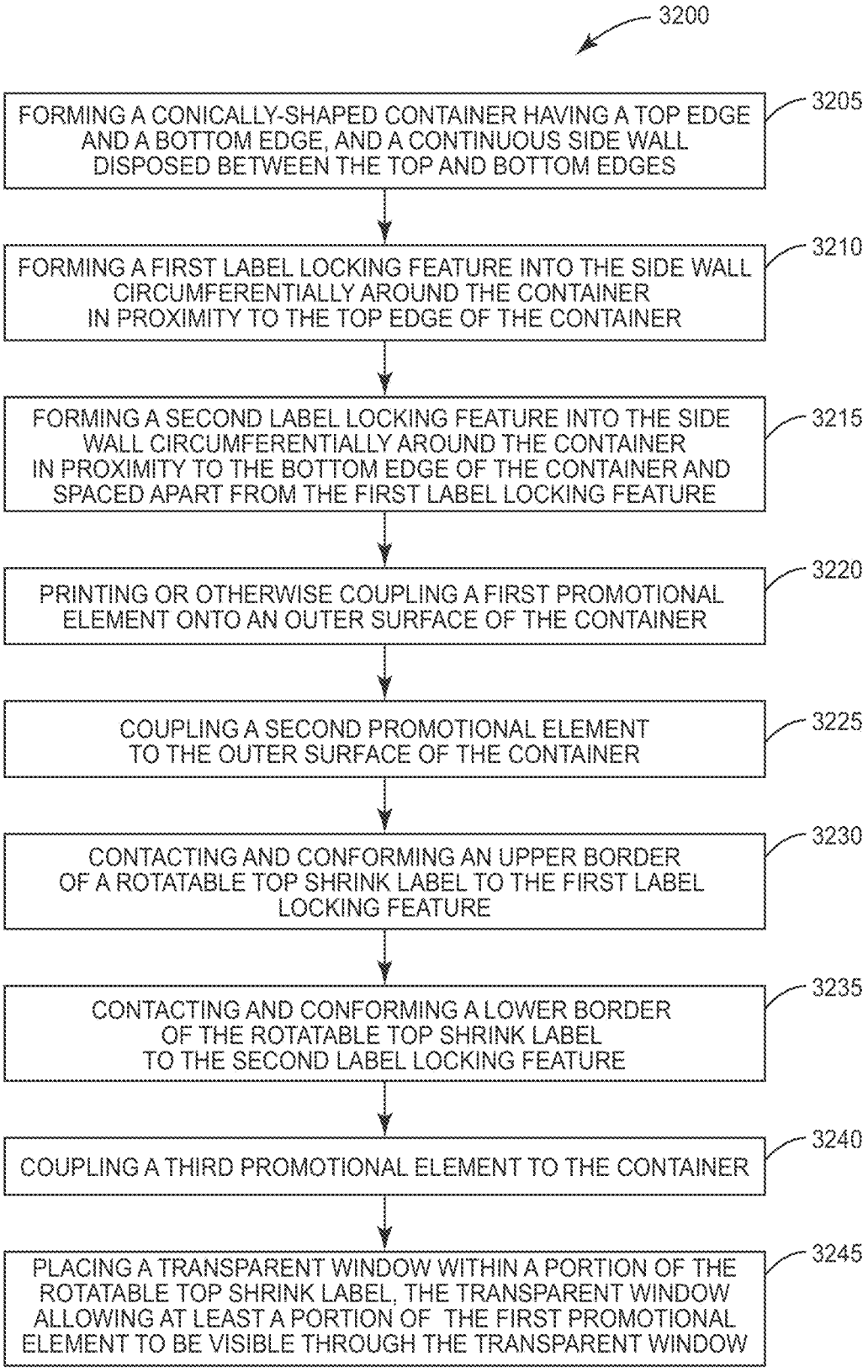
FIG. 32 is an exemplary flow diagram of a method for producing an interactive promotional label system for a container according to various embodiments.

FIG. 32 illustrates a general flow chart of various embodiments of a method 3200 for producing an interactive promotional label system of a container 1205. A conically-shaped container 1205 having a top edge and a bottom edge, and a continuous side wall 1215 disposed between the top edge and the bottom edge may be formed at step 3205. A first label locking feature 1305 may be formed circumferentially around the container 1205 in proximity to the top edge 1315 at step 3210. At step 3215, a second label locking feature 1310 may be formed circumferentially around the container 1205 in proximity to the bottom edge 1320. A first promotional element may be printed or otherwise coupled at step 3220 to an outer surface 506 of the container 1205. The first promotional element may comprise indicia or other promotional material 1210. At step 3225, a second promotional material may be coupled to the outer surface 506 of the container 1205. The second promotional material may comprise a rotatable top shrink label 300 having indicia or other promotional material 308 printed thereon. At step 3230, an upper border 1605 of the rotatable top shrink label 300 may be contacted and conformed to the first label locking feature 1305, and at step 3235, a lower border 1610 of the rotatable top shrink label 300 may be contacted and conformed to the second label locking feature 1310. A third promotional element may be coupled to the container 1205 at step 3240. The third promotional element may comprise a game piece 2005 or other indicia or promotional material 2210 that links with either or both of the first and second promotional elements to complete a promotional event. At step 3245, a transparent window 1002 may be placed within a portion of the rotatable top shrink label 300, the window 1002 allowing at least a portion of the first promotional element to be visible through the window 1002.

In various embodiments, all or a portion of the indicia 1210 may be imprinted, embossed, or molded directly on the external surface 506 of the container 1205. The imprinting or embossing may be carried out using any printing or image transfer method known in the art. In various embodiments, the printing or image transfer method may be an offset process in which an image is transferred from a plate to an intermediate carrier, then to the external surface 506 of the container 1205. The offset process may also involve lithographic techniques. Other printing or image transfer methods may comprise, for example, flexography, pad printing, relief printing, rotogravure, screen printing, and electrophotography. According to various embodiments, the indicia 106 may be digitally printed on the external surface 506 of the container 1205 using, for example, inkjet printing or laser printing. Chemical printing technologies, such as blueprint or diazo print may also be used in various embodiments.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A container and shrink label system, comprising:

a conically-shaped container having a top edge and a bottom edge, and a continuous side wall disposed between the top edge and the bottom edge;

a first label locking feature formed into the side wall circumferentially around the container in proximity to the top edge of the container;

a second label locking feature formed into the side wall circumferentially around the container and spaced apart from the first label locking feature, a rotatable shrink label having an upper border and a lower border and positioned around the side wall such that the label upper border is in contact with and conforms to the first label locking feature, and the label lower border is in contact with and conforms to the second label locking feature;

a removable game piece coupled to the container that comprises a game piece indicia; and a cup indicia located on the cup, the cup indicia comprising a QR code, which causes a QR scanning device to execute a function that causes the QR scanning device to display instructions to input the game piece indicia which is used by the function to determine whether the game piece is a winning game piece to thereby complete a promotional event.

2. The container and shrink label system of claim 1, wherein the first label locking feature protrudes outward from the side wall.

3. The container and shrink label system of claim 1, wherein the second label locking feature protrudes outward from the side wall.

4. The container and shrink label system of claim 1, wherein the conically shaped container comprises a cup shaped such that multiple cups are nestable, one within the other.

5. The container and shrink label system of claim 1, wherein at least one of the first and second label locking features is continuous around a circumference of the container.

6. The container and shrink label system of claim 1, wherein the shrink label further comprises a back surface in contact with the side wall, and a low friction coating on the back surface to facilitate rotation of the shrink label.

7. The container and shrink label system of claim 1, wherein the first and second label locking features inhibit movement of the shrink label in a longitudinal direction and allow rotational movement of the shrink label.

8. A container and shrink label system, comprising:

a conically-shaped container having a top edge and a bottom edge, and a continuous side wall disposed between the top edge and the bottom edge;

a first label locking feature formed into the side wall circumferentially around the container such that the first label locking feature is raised as a protrusion and not a ledge with respect to a surface of the container;

a second label locking feature formed into the side wall circumferentially around the container and spaced apart from the first label locking feature such that the second label locking feature is raised as a protrusion and not a ledge with respect to a surface of the container;

a rotatable shrink label having an upper border and a lower border and positioned around the side wall such that the label upper border is in contact with and conforms to and wraps around the first label locking feature, and the label lower border is in contact with and conforms to and wraps around the second label locking feature;

a cup indicia located on the cup;

a removable game piece coupled to the container, wherein the game piece comprises a game piece indicia that is configured to possibly match the cup indicia, and when it so matches to thereby complete a promotional event; and a plurality of container indicia, wherein only one of the container indicia completes the promotional event.

* * * * *